US009085944B2

(12) United States Patent
LaValley et al.

(10) Patent No.: US 9,085,944 B2
(45) **Date of Patent: *Jul. 21, 2015**

(54) GRIPPING ASSEMBLY AND GRIPPING MEMBERS FOR A GRAPPLE ATTACHMENT

(71) Applicant: LaValley Industries, LLC, Bemidji, MN (US)

(72) Inventors: Jason LaValley, Bemidji, MN (US); Roger LaValley, Bemidji, MN (US); Marvin Larson, Bemidji, MN (US); Lawrence D. Kilpo, Duluth, MN (US); Michael Burgess, Duluth, MN (US)

(73) Assignee: LAVALLEY INDUSTRIES, LLC, Bemidji, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/036,596

(22) Filed: Sep. 25, 2013

(65) Prior Publication Data

US 2014/0028042 A1 Jan. 30, 2014

Related U.S. Application Data

(63) Continuation of application No. 12/794,877, filed on Jun. 7, 2010, now Pat. No. 8,567,836, which is a continuation-in-part of application No. 12/201,897, filed on Aug. 29, 2008, now Pat. No. 8,146,971.

(60) Provisional application No. 60/969,418, filed on Aug. 31, 2007.

(51) Int. Cl.
*B66C 1/42* (2006.01)
*E21B 19/20* (2006.01)
(Continued)

(52) U.S. Cl.
CPC ..... *E21B 19/155* (2013.01); *E21B 19/14* (2013.01)

(58) Field of Classification Search
USPC ..... 294/86.4, 103.1, 198, 86.41, 67.5, 294/81.61, 106; 414/744.8, 815, 732, 739; 228/49.3; 901/38, 39; 144/4.1, 34.1, 144/34.5
See application file for complete search history.

(56) References Cited

U.S. PATENT DOCUMENTS 3,231,303 A 1/1966 LeTourneau
3,311,350 A 3/1967 Irwin
(Continued)

FOREIGN PATENT DOCUMENTS

CA 2641321 4/2009
DE 29502091 4/1995
(Continued)

OTHER PUBLICATIONS

Extended European Search Report for European Application Serial No. 11792851.5, dated Jan. 14, 2014, 7 pages.
(Continued)

*Primary Examiner* — Paul T Chin
(74) *Attorney, Agent, or Firm* — Hamre, Schumann, Muelller & Larson, P.C.

(57) ABSTRACT

A gripping assembly with gripping members, as part of a grapple attachment, used to grasp and manipulate elongated objects, for example pipe, is described. Due to the gripping action of the gripping members and tilt control capabilities of the grapple attachment, total positive control of the pipe is maintained, even if the gripping assembly picks up pipe off center. The grapple attachment is able to be used on all pipe surface types, including pipe surfaces that are dirty, snow or ice covered. The gripping members are configured to prevent damage to the pipe and to adjacent pipes, and will not crush the pipe.

22 Claims, 15 Drawing Sheets

(51) Int. Cl.
*E21B 19/15* (2006.01)
*E21B 19/14* (2006.01)

(56) References Cited

U.S. PATENT DOCUMENTS

| | | | | |
|---|---|---|---|---|
| 3,333,717 | A | 8/1967 | Scaperotto | |
| 3,561,615 | A | 2/1971 | Forsberg et al. | |
| 3,713,554 | A | 1/1973 | Thompson et al. | |
| 3,719,296 | A | 3/1973 | Larson, Jr. | |
| 3,727,653 | A | 4/1973 | Tucek | |
| 3,817,567 | A | 6/1974 | Lull | |
| 3,911,981 | A | 10/1975 | Tucek | |
| 3,927,778 | A | 12/1975 | Zrostlik | |
| 4,212,577 | A | 7/1980 | Swanson | |
| 4,486,136 | A | 12/1984 | Howard | |
| 4,697,509 | A | 10/1987 | LaBounty | |
| 4,810,019 | A | 3/1989 | Brucher | |
| 4,858,979 | A | 8/1989 | Parma | |
| 4,951,990 | A | 8/1990 | Hollan et al. | |
| D323,169 | S | 1/1992 | Saito | |
| 5,209,536 | A | 5/1993 | Rogers, Sr. et al. | |
| 5,219,265 | A | 6/1993 | Recker | |
| 5,330,242 | A | 7/1994 | Lucky, Sr. | |
| 5,562,386 | A | 10/1996 | Browning | |
| 5,607,251 | A | 3/1997 | Rafn | |
| 5,918,923 | A | 7/1999 | Killion | |
| 5,975,604 | A | 11/1999 | Wolin et al. | |
| 6,024,145 | A | 2/2000 | Ackles | |
| 6,176,531 | B1 | 1/2001 | Wheeler | |
| 6,220,807 | B1 | 4/2001 | Sorokan | |
| 6,280,119 | B1 * | 8/2001 | Ryan et al. | 405/156 |
| 6,347,464 | B1 | 2/2002 | Klager | |
| 6,729,832 | B1 | 5/2004 | Word, III et al. | |
| 7,066,076 | B2 | 6/2006 | Roy et al. | |
| 7,357,163 | B2 | 4/2008 | Wager | |
| 7,503,606 | B2 | 3/2009 | Hall et al. | |
| 7,950,709 | B1 | 5/2011 | Cheney et al. | |
| 7,980,612 | B2 | 7/2011 | Hall et al. | |
| D645,062 | S | 9/2011 | LaValley et al. | |
| 8,146,971 | B2 | 4/2012 | LaValley et al. | |
| 8,328,071 | B2 | 12/2012 | LaValley et al. | |
| 8,348,319 | B2 * | 1/2013 | LaValley et al. | 294/86.41 |
| 8,444,366 | B2 | 5/2013 | Cole | |
| 8,567,836 | B2 * | 10/2013 | LaValley et al. | 294/198 |
| 2007/0110553 | A1 | 5/2007 | Neal et al. | |
| 2007/0280812 | A1 | 12/2007 | Morency et al. | |
| 2009/0057019 | A1 | 3/2009 | LaValley et al. | |
| 2009/0155040 | A1 | 6/2009 | Martin | |
| 2010/0308609 | A1 | 12/2010 | LaValley et al. | |

FOREIGN PATENT DOCUMENTS

| | | |
|---|---|---|
| DE | 10206645 | 8/2003 |
| DE | 102007034506 | 2/2008 |
| GB | 2286877 | 8/1995 |
| KR | 20-0227816 | 6/2001 |
| WO | 00/53522 | 9/2000 |
| WO | 00/65193 | 11/2000 |
| WO | 03/082725 | 10/2003 |
| WO | 2007/097698 | 8/2007 |
| WO | 2008/076067 | 6/2008 |
| WO | 2009/029879 | 3/2009 |

OTHER PUBLICATIONS

Drawings and Photographs of a Grapple manufactured by WELDCO BEALES MFG., in Applicant's possession on or about Mar. 20, 2010, 15 pages.

Drawings of Heavy Duty Pole Claw manufactured by EZ-Spot-UR, dated Apr. 29, 2010, found online at http://www.erspotur.com/HDPC-01-0006_NO_SETBACK.pdf, 1 page.

Five photographs taken in Jan. 2010 of a grapple mechanism used by Michels Corporation.

Indexator Rototilt® print outs from www.indexatornorthamerica.com/index.php, printed on Sep. 8, 2011, 10 pages.

"Kinshofer Manipulators—Kinshofer-KM930", available at http://www.worktruck-outfitters.com/kinshofer-manipulators-p-1281.html, printed May 13, 2010, 4 pages, May 2010.

"Manipulator KM 930", Kinshofer GmbH, available at http://www.kinshofer.com/site_eng/produkte_main/main_km930.html, printed May 13, 2010, 1 page.

"Manipulator KM 930", Kinshofer Gmbh, available at http://www.kinshofer.com/site_eng/produkte_main/Resources/KM_930_eng.pdf , printed May 13, 2010, 1 page.

Photograph of Manipulator manufactured by Kinshofer GmbH of Germany, 1 page.

Pictures of a grapple mechanism printed from http://rotobec.com/web/2610_PH_Pipe_and_Pole-Handler.html and http://rotobec.com/resources/images/products/rotations/RGP-252_main.jpg on Mar. 30, 2010, but possibly posted on the Internet as early as Sep. 2009, 2 pages.

Prentice 2410-2414 Knuckleboom Loaders, printed Sep. 8, 2011 from http://prenticecranes.com/prentice-2410-2414-knuckleboom-loaders.html, 6 sheets.

Prentice Grapples specification sheet, printed Sep. 8, 2011 from http://prenticecranes.com/prentice-grapples.html, 6 sheets.

"Selector/Demolition Grabs", McQuaid Engineering Ltd, available at http://www.alibaba.com/product/mcquaid84-215959236-0/Selector_Demolition-Grabs.html, printed May 13, 2010, 3 pages.

"Selling GB Wood Grapple products", GB Industries Co. Ltd, available at http://kennycho.trustpass.alibaba.com/product/107764499-11334694/Selling_GB_Wood_Grapple_products.html, printed May 13, 2010, 3 pages.

* cited by examiner

GRIPPING ASSEMBLY AND GRIPPING MEMBERS FOR A GRAPPLE ATTACHMENT

This application is a continuation of U.S. patent application Ser. No. 12/794,877, filed on Jun. 7, 2010, which is a continuation-in-part of U.S. patent application Ser. No. 12/201,897, filed on Aug. 29, 2008, now U.S. Pat. No. 8,146,971, which claims the benefit of U.S. Provisional Application No. 60/969,418, filed Aug. 31, 2007, each of which is incorporated by reference herein in its entirety.

FIELD

This disclosure relates to a gripping assembly with gripping members, as part of a grapple attachment, for grasping and manipulating elongated objects, for example cylindrical elongated objects such as pipes, tubes, trees, etc. or non-cylindrical objects such as I-beams, rectangular or square tubing, etc. The grapple attachment is attachable to, for example, a trackhoe, backhoe, excavator or other piece of heavy construction equipment.

In addition, the present invention pertains to a grapple for grasping and manipulating drill pipes used with a directional drilling rig that can be attached to a trackhoe, backhoe, excavator or other piece of heavy construction equipment.

BACKGROUND

In the construction of pipelines or in directional drilling, it is necessary to load and offload large, unwieldy pipes from flatbed trucks. The weight of a pipe will vary depending on the diameter, wall thickness, and length, with some pipes weighing several hundred pounds per linear foot.

At the construction site, each pipe is individually lifted from or loaded onto the bed of a truck, rail car or pipe rack. Normally, nylon straps and cables, with or without manual calipers, are secured around the pipe than attached to the bucket of an excavator. The calipers or nylon straps are placed, as close as possible, at the longitudinal center of the pipe. This is important since being off-center, even by a few inches, results in decreased control and unwanted tilt of the pipe. In addition, it is necessary to station at least one worker at each end of the pipe to steady and guide the pipe as it is moved into location. The workers then manually tilt and rotate the pipe into position. This is cumbersome and dangerous which requires three or more workers (excavator operators and two pipe workers).

Pipe hooks are also used to manipulate the pipe. The pipe hooks are located at each end of the pipe and are attached to cables. A worker is provided at each end of the pipe to place the hooks and control the motion of the pipe. When unloading the pipe from the truck in this manner, it is dangerous for the worker as the worker can easily fall off of the truck or be hit by or crushed by the pipe.

Current pipe loaders also require that pipes be loaded/offloaded in a certain order and that spacing be provided between pipes so that the calipers are able to access the areas next to and under the pipes. Even so, it is not uncommon for pipes to be knocked free of the pipe pile, causing dangerous conditions or damaging the pipe.

Pipeline vacuum lifts are also used to lift large diameter pipes. While a vacuum lift eliminates the need for workers at each pipe end, the vacuum lift needs to be generally centered on the pipe to avoid tilting of the pipe. If the vacuum lift is not centered properly on the pipe, an off center lift occurs creating a tipping movement. This tipping movement can break the vacuum seal between the vacuum lift and the pipe or result in dangerous tilting and loss of control of the pipe. In addition, loss of suction or vacuum power can result in release of the pipe from the vacuum lift resulting in dangerous conditions. In addition, in order to obtain an effective seal of the vacuum lift, the surface of the pipe must be clean without the presence of any dirt, snow or ice.

SUMMARY

A gripping assembly with gripping members, as part of a grapple attachment, used to grasp and manipulate elongated objects, for example pipe of various diameters and lengths, is described. The gripping attachment is configured to improve loading and unloading of pipe to and from a stack of pipes, for example, on a bed of a truck, rail car or pipe rack with minimal disturbance of or damaging of adjacent pipes or the pipe coating while providing control over the positioning of the pipe, as well as permit controlled laying of pipe, while reducing manpower and eliminating the need for precise centering of the gripping assembly on the pipe. Due to the gripping action of the gripping members and tilt, rotation and shift control capabilities of the grapple attachment, total positive control of the pipe is maintained, even if the gripping assembly picks up the pipe off center. The grapple attachment is able to be used on all pipe surface types, including pipe surfaces that are dirty, or snow or ice covered. The gripping members are configured to prevent damage, not only to the pipe being manipulated, but to adjacent pipes. The gripping members are configured so that the gripping pressure will not crush the pipe.

The gripping members are used at least in pairs and are mounted on a common main beam structure so that they are separated from each other. The gripping members are interchangeable with other gripping members to permit the grapple attachment to grasp different sized objects, thereby providing modularity to the grapple attachment. In one embodiment, the configuration of the gripping member grab arms allow for the pipe to be clamped or grasped by the grab arms and not rolled into the grab arms as is typical.

In one embodiment, the gripping members are configured to be adjustable together to change their position on the main beam structure while maintaining the distance between the gripping members. In another embodiment, one or more of the gripping members are adjustable on the main beam structure in order to alter the distance between the gripping members. In another embodiment, the gripping members are fixedly attached to the main beam structure. As an alternative, the main beam structure can be configured to be adjustable in length, thereby altering the distance between the gripping members, or altering the positions of the gripping members while maintaining the distance therebetween. In addition, the main beam structure can be configured so that it moves on the longitudinal axis in relation to the swivel assembly.

In one embodiment, a gripping member useable with a gripping assembly of a grapple attachment is provided that includes a support member. The support member includes a main beam structure opening extending laterally therethrough that is configured to receive a main beam structure of the gripping assembly. A first grab arm and a second grab arm are connected to the support member. Each of the first grab arm and the second grab arm taper toward a free end, and at least one of the first and second grab arms is pivotally connected to the support member so that the first and second grab arms have a gripping position and a non-gripping position. A first actuator has one end connected to the support member and a second end connected to the one pivotally connected grab arm. The support member and the first and second grab arms define an object receiving area when the first and second grab arms are at the gripping position, where the object receiving area is disposed below the main beam structure opening.

In another embodiment, a grapple attachment includes a bracket attachment configured to attach to a piece of construction equipment, a lower head assembly connected to the bracket attachment and configured to be rotatable about a swivel axis, and a gripping assembly pivotally connected to the lower head assembly for pivoting movement about a pivot axis that is substantially perpendicular to the swivel axis. The gripping assembly includes a main beam structure that extends along a longitudinal axis that is substantially perpendicular to the swivel axis and the pivot axis. A plurality of gripping members are connected to the main beam structure, and each of the plurality of gripping members are actuatable between a non-gripping position and a gripping position. At least one of the gripping members is adjustable in position relative to the swivel axis and the pivot axis in a direction parallel to the longitudinal axis.

Each gripping assembly uses actuators, for example hydraulic actuators, to actuate the gripping motion by moving one or more grab arms, for tilting the main beam structure, and to adjust the location of the gripping members. Load hold valves are provided ensuring that the grab arms stay locked in position if a hydraulic hose fails.

In one embodiment, the gripping member comprises one stationary grab arm and one movable grab arm where the grab arms are on the same plane or vertical axis. In another embodiment, the gripping member comprises two movable grab arms where the grab arms are angled, creating six points of contact which is useful for picking up pipe, and the grab arms are not on the same vertical axis, i.e. offset. In another embodiment, the gripping member comprises two movable grab arms where the grabs arms are crescent shaped and offset.

The gripping members are preferably made primarily of metal, and include a support member formed by spaced apart plates or forged or molded from solid metal.

The gripping members described herein provide a more precise fit around the pipe. There is positive total control of the pipe and no free direction of movement due to the elimination of unwanted swing and tilt.

One embodiment of the invention pertains to a grapple attachment for an excavator or other suitable piece of heavy machinery. The grapple attachment includes a bracket for attachment to the bucket attachment on an excavator, a swivel assembly to permit the main body of the grapple attachment to rotate in either direction and a main body pivotably connected to the swivel assembly at a pivot point and with a hydraulic arm that permits the main body to be angled at up to 35 degrees. The main body includes a pair of gripping members spaced apart on a rigid lateral member. Each gripping member includes a first and second claw. The gripping member may include a bracket having a curved contact surface and each of the claws may include a curved gripping surface such that the gripping surface of the claws and the contact surface are in contact with the drill pipe when grabbing the drill pipe. The grapple attachment can be used to easily and efficiently move and angle the drill pipe into position for attachment to the drill string with total control by the excavator operator without the need for assistance and manipulation by other workers.

Another embodiment of the invention pertains to a grapple attachment that includes a bracket for attachment to a piece of heavy machinery, a swivel assembly to permit the main body of the grapple attachment to rotate in either direction and a main body pivotably connected to the swivel assembly so that the main body can be pivoted using hydraulics or other means with respect to the swivel assembly. A pair of gripping members may be slidably disposed on the main body so that the pair of gripping members may be slid back and forth on the main body to provide a further positioning aid.

DRAWINGS

DETAILED DESCRIPTION

A gripping assembly with gripping members, as part of a grapple attachment, used to grasp and manipulate elongated objects, for example pipe, is described.

Throughout this specification, for ease of discussion and clarity, reference and description will be made to the objects as being pipe. The described grapple attachment can be used in the pipeline construction industry to grasp and manipulate pipe of varying diameters, including large diameter pipe, for example 20 inch pipe, but can be used in other industries as well, such as the logging industry, to grasp other objects. It is to be understood that the concepts as described herein can be equally applied to the grasping and manipulating of any elongated objects, whether cylindrical or non-cylindrical, for example pipes, cylindrical tubes, trees, I-beams, square tubes, triangular tubes, etc.

The grapple attachment allows for the picking of pipe from, and placement of pipe on, a stack of pipes without disturbing or damaging adjacent pipes while providing control over the positioning of the pipe. The grapple attachment can also be used to lay pipe, for example in a trench, and to remove pipe. The grapple attachment is able to be used on all pipe surface types, including pipe surfaces that are dirty, or snow or ice covered. The gripping members are configured to prevent damage, not only to the pipe being manipulated, but to adjacent pipes and the coatings of the adjacent pipes. The gripping members are configured so that the gripping pressure will not crush the pipe.

The grapple attachment uses actuators, for example, to actuate the gripping motion by moving grab arms, for tilting the main beam structure and to alter the positions of the gripping members. The actuators described herein can be hydraulic actuators, pneumatic actuators, mechanical actuators such as screw-type actuators or geared actuators, or other actuators suitable for the purpose.

As described herein, an open or non-gripping position is one in which first and second grab arms are moved away from each other so that a pipe can fit in the space between the grab arms. A closed or gripping position is one in which the grab arms are moved towards each other so that a pipe located between the grab arms is squeezed between the grab arms to permit the pipe to be picked up. The configuration of the grab arms results in the pipe being clamped or grasped by the grab arms and not rolled into the grab arms as is typical.

Figure 1:
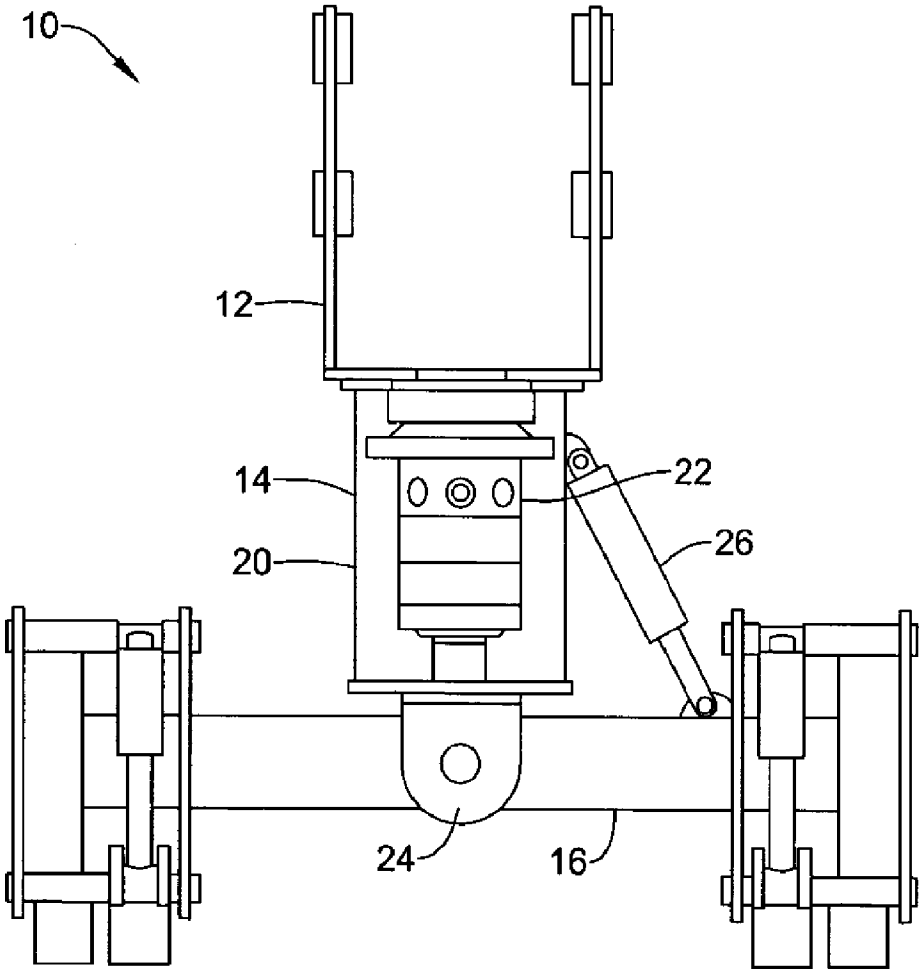
FIG. 1 is a diagrammatic plan view of another embodiment of a grapple attachment.
Figure 2:
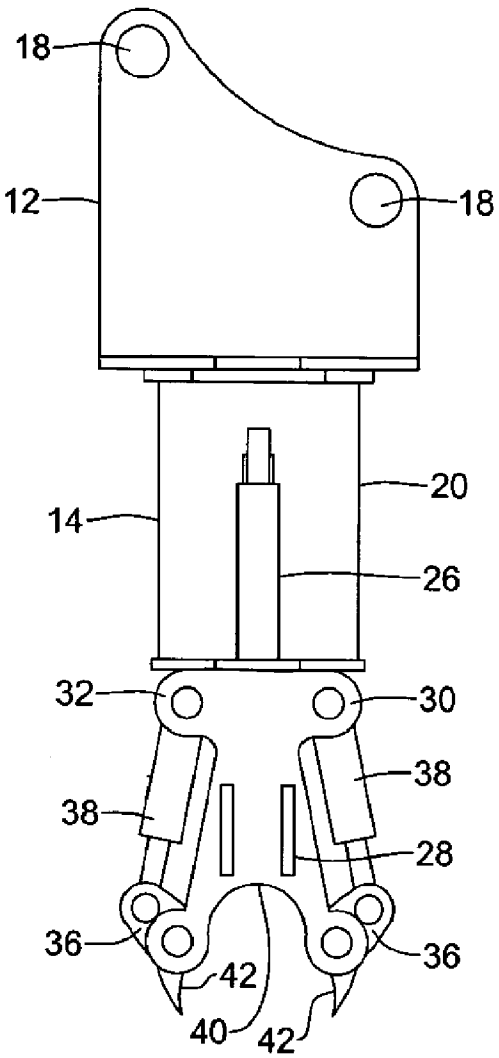
FIG. 2 is a diagrammatic side view of the grapple attachment of FIG. 1.
Figure 3:
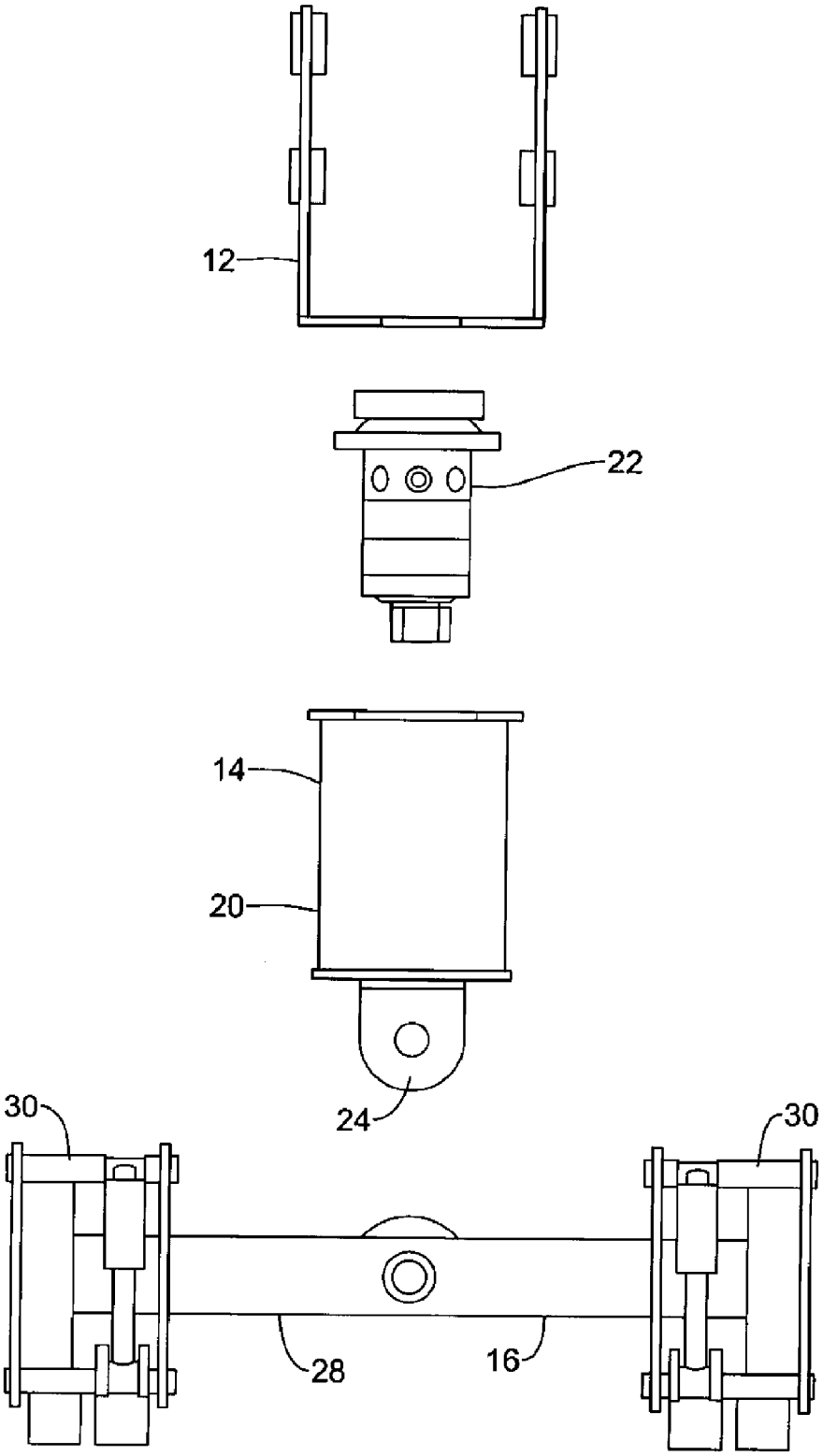
FIG. 3 is a diagrammatic exploded plan view of the grapple attachment of FIG. 1.

A grapple attachment 10 in accordance with the invention is depicted in diagrammatic fashion in plan view in FIG. 1, in side view in FIG. 2 and in an exploded plan view in FIG. 3. The grapple attachment includes a bracket attachment 12, a swivel assembly 14 and a main body 16.

The terms horizontal, vertical, lateral and like terms are used herein with respect to the grapple attachment as depicted in FIG. 1. Thus horizontal and lateral are the left and right of FIG. 1 and vertical is the up and down of FIG. 1. For example, the main body 16 may be said to extend in predominately a lateral direction. This usage of the terminology should not be interpreted to mean that the components so described must always be as described in an absolute sense. The grapple attachment attaches to a hydraulic arm of a piece of heavy equipment and it is possible, for example, to manipulate the grapple attachment so that the main body 16 is predominately vertical in an absolute sense. However, for the purposes of this discussion, the vertical direction extends through the bracket attachment, the swivel assembly and the main body and the horizontal direction is perpendicular thereto.

The grapple attachment is hooked up to an excavator or other piece of heavy equipment. The term excavator is used throughout this description for the sake of simplicity but other pieces of heavy equipment may be suitable for use with a grapple attachment according to the invention. For example, the grapple attachment may be used with a trackhoe, backhoe or any other piece of equipment having a suitable arm.

The bracket attachment 12 includes holes 18 to provide a mechanical interface with a boom arm. The bracket is thus rigidly connected to the end of the stick arm with no degrees of freedom. The bracket attachment as shown is suitable for attachment to a standard stick arm. Any bracket suitable for rigid attachment to a stick arm is within the scope of the invention. The bracket attachment may also include pins sized to span the width of the bracket and fit within holes 18. The size and position of holes 18 may be varied as desired to adapt the bracket to a specific excavator model.

The swivel assembly 14 includes a swivel assembly housing 20 and a hydraulic rotation control 22. The rotation control 22 is disposed in the center of the housing 20 and is rigidly connected thereto with bolts or other suitable fastener. One end of the rotary control is attached to the bracket attachment 12 with bolts or other suitable fasteners. The rotation control 22 can be operated to rotate the swivel assembly 14 with respect to the bracket attachment about a vertical axis. The rotation control preferably includes a hollow center throat (not shown) extending through the device along a vertical axis to permit hydraulic lines or other conduits to be routed through the center of the hydraulic rotation control 22. Swivel assembly housing 20 includes a housing 22 for receiving the hydraulic rotation control and a bottom bracket 24 for pivotably connecting the swivel assembly to the main body 16.

In one alternative embodiment, the grapple attachment may include a "parking brake" (not shown) mounted between the swivel assembly and the bracket attachment. The parking brake may include a ring mounted on the swivel assembly and a spring loaded hydraulic caliper mounted on the bracket assembly. Such a feature would prevent rotational creep between the bracket attachment and the swivel assembly when the grapple attachment is not in use. Of course, other devices are contemplated which may provide a similar feature. For example the parking brake may be electrically powered rather than hydraulically or may be manually activated or deactivated with a lever, for example. Other alternatives such a manually activated latch system extending between the bracket attachment and the swivel assembly are also contemplated.

The main body 16 is pivotably connected to the bottom bracket 24 of the swivel assembly and is also connected to the swivel assembly by a tilt arm 26 disposed to one side of the swivel assembly 14. The pivot connection includes a central pin, a bushing such as a rubber bushing or a steel bushing and/or other elements suitable to a load bearing pivot connection of this type. The tilt arm 26 is pivotably connected to both the swivel assembly housing 20 and the main body and is preferably a hydraulic arm. Both connections acting together ensure that the main body can pivot about a horizontal axis up to a maximum of about 30 degrees from the horizontal. In some embodiments that maximum is 40 degrees from the horizontal; in other embodiment that maximum is 25 degrees from the horizontal.

Figure 4:
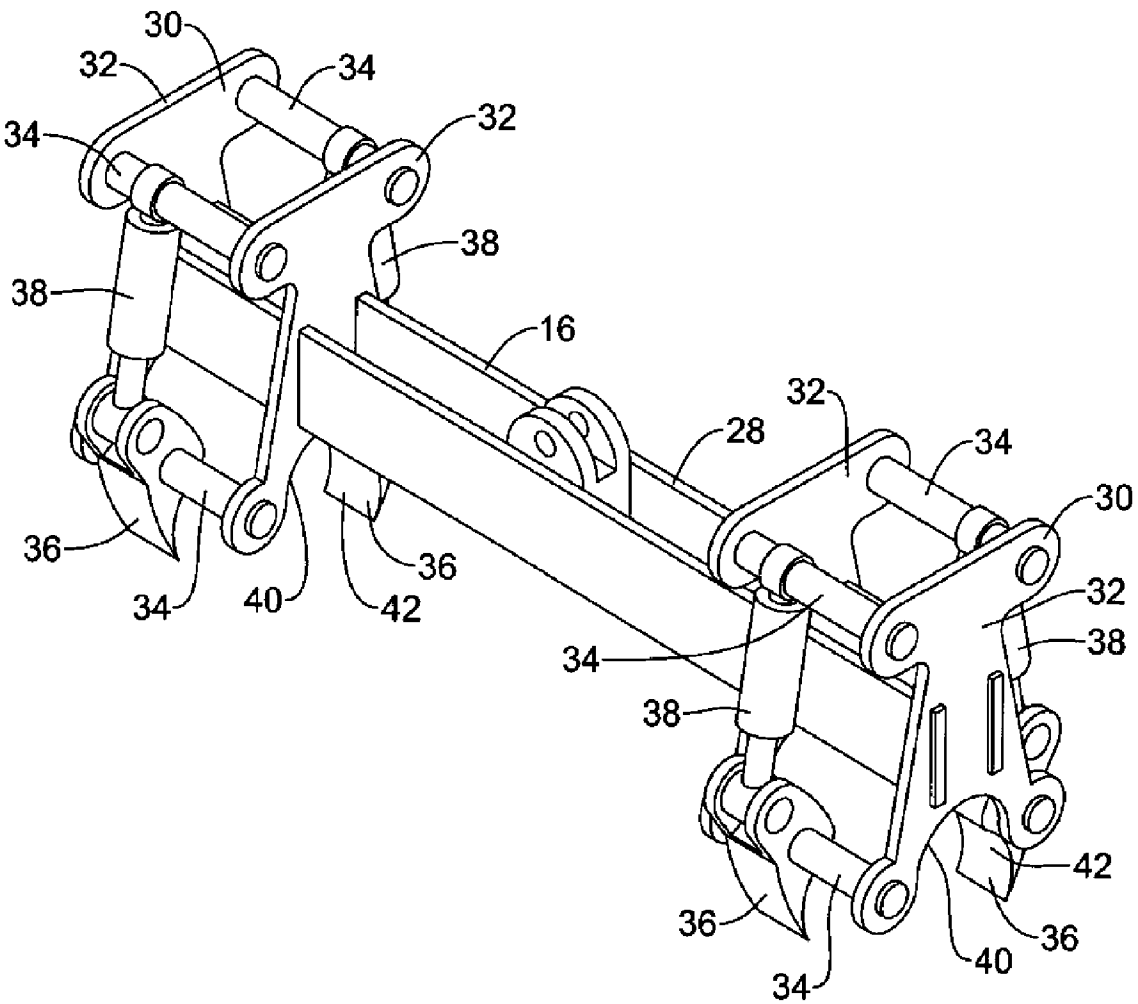
FIG. 4 is a diagrammatic orthogonal view of a main body 16 portion of a grapple attachment.

The main body includes a rigid lateral member 28 that has first and second gripping members 30 disposed thereon. Each gripping member 30 may include a first and second bracket 32 spaced apart by rods 34 and a first and second claw 36. Each claw has a first hole for mounting the claw on and rotating the claw about a rod 34 and a bracket for mounting to one end of a hydraulic piston 38. The other end of the hydraulic piston is mounted on another rod 34. The hydraulic piston serves to actuate the claw between an open position and a closed position. The first and second claw of each gripping member may be spaced laterally apart from each other as shown in FIG. 4 or may line up to open and close in the same plane. Preferably, each bracket has a concave contact surface 40 that has a radius equal to half the diameter of a drill pipe. A typical embodiment is built for use with a drill pipe having a nominal 6 and ⅝ inch outer diameter. Alternatively, the concave contact surface may have a radius that is slightly larger than half the diameter of a drill pipe. Preferably, each claw has a curved gripping surface (indicated at 42) that also has a radius that is half the diameter of a drill pipe. Each gripping member may be configured so that the bracket contact surface 40 and gripping surfaces 42 of first and second claws 36 come in contact with the drill pipe when closed over the drill pipe. Preferably, and as depicted in FIG. 2, each claw 36 has a profile that rapidly tapers towards a free end. As the free end of the claw pictured has a convex side (the gripping surface 40) and a concave side, the claw free end may be described as having a profile like that of the end of a crescent moon. Of course, other tapering profiles are contemplated. For example, a claw having a snub nose profile may be suitable for use with some embodiments of the invention.

The gripping members are configured so that they open and close simultaneously. When open, the gripping surfaces of the claws preferably extend no more than the diameter of a drill pipe from a central vertical plane extending through the width of the main body. For example, for a typical embodiment built for use with a drill pipe of 6 and ⅝ inch diameter, each claw may extend no more than 6 inches or no more than 5 and ½ inches from the central vertical plane of the main body. In such a case the maximum distance between the free ends of first and second claws of a gripping member, when looking at an end view of the gripping member as in FIG. 2, is 12 or 11 inches, respectively. This limit on the maximum expansion of the gripping member may be made by selection and design of the parts of the gripping member such that it is physically impossible to further expand the claws of the gripping member or may be done through electronic controls and software.

Of course, other embodiment are contemplated which are adapted for pipes of other diameters. Other standard drill pipe diameters are (all in inches) 2⅜, 2⅞, 3½, 4, 4½, 5½, 6⅝, 7⅝ and 8⅝. The gripping members including the claws and the brackets may be particular adapted for one or more of these standard drill pipe sizes or with a pipe of a different diameter in mind.

The hydraulic rotation control 22, the hydraulic arm 26 and the hydraulic pistons 38 require a hydraulic power source. In a preferred embodiment, the grapple attachment 10 also includes a hydraulic manifold (not shown). Hydraulic power lines, electrical power lines and control lines are connected to the manifold and hydraulic power is sent through the manifold as desired to operate the hydraulic accessories. The hydraulic power lines may be routed through the throat of the hydraulic rotation control to keep them inside the grapple attachment and protect them during operation.

A grapple attachment according to the invention may also include control members which can be attached to the control panel of the cab of the excavator using conventional methods.

Figure 5:
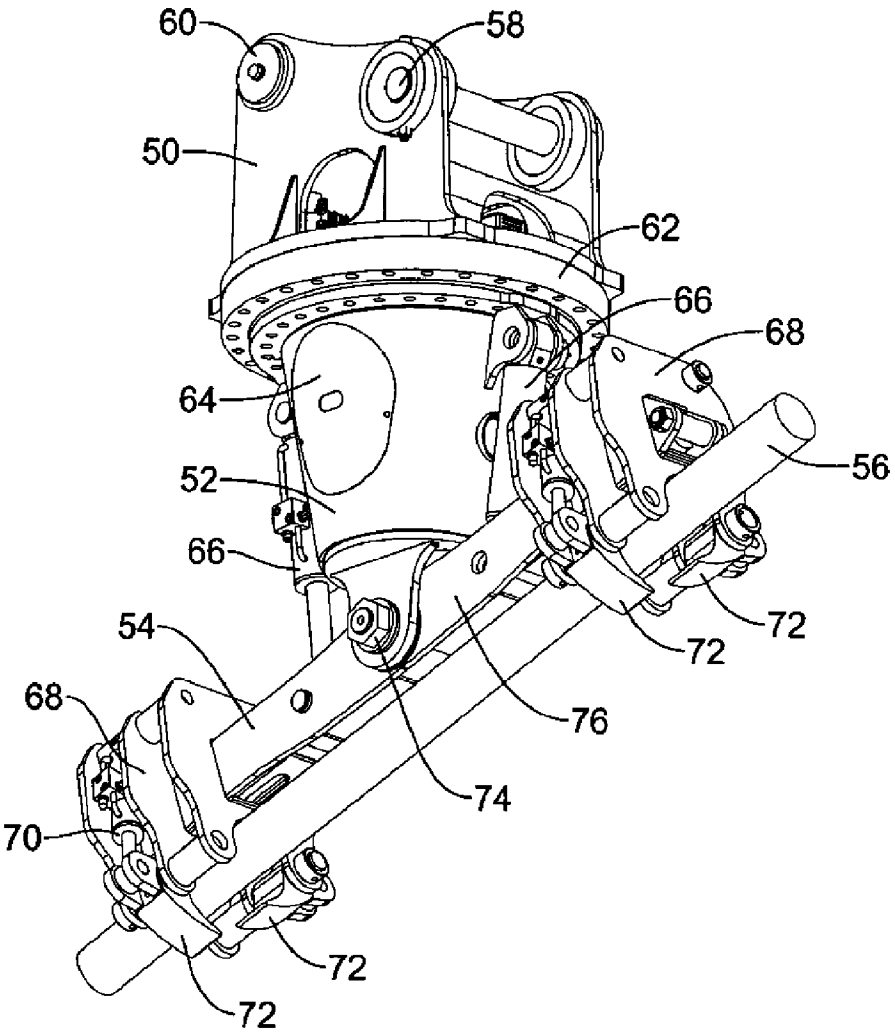
FIG. 5 is a diagrammatic orthogonal view of a grapple attachment.
Figure 6:
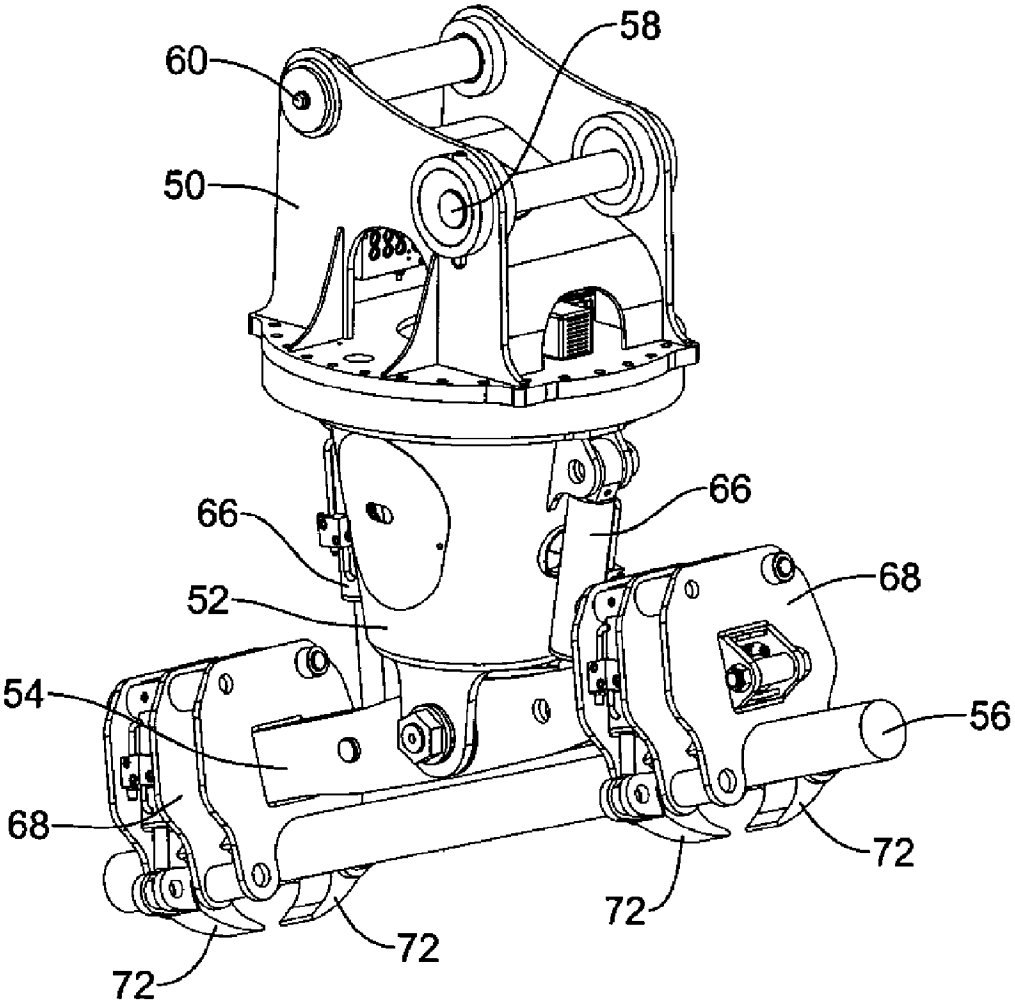
FIG. 6 is a diagrammatic orthogonal view of the grapple attachment of FIG. 5.

Another embodiment is illustrated by orthographic projection in FIG. 5. This embodiment includes, generally, an attachment bracket 50, a main housing 52 and a main beam 54. The attachment bracket is adjustable to fit a variety of sizes of boom arm fittings. Pins 58 and 60 may be 80 mm to 90 mm in diameter and may be replaced with pins of a different diameter as desired. Pin 58 is offset in its fixture and may be rotated to adjust the distance between the two pins to provide flexibility in attaching to various boom arms.

The attachment bracket 50 may be attached to the main housing 52 by a slewing ring 62, which allows free rotation of the main housing with respect to the attachment bracket. The slewing ring includes an outer ring fixed to the attachment bracket and an inner ring fixed to the main housing. Each of the outer and inner rings includes a bearing race to confine a set of bearings to permit the rotation. In one contemplated embodiment, a hydraulic motor disposed in the attachment bracket is connected to a shaft by a pinion to control the rotation of the main housing. Of course, any suitable mechanism may be used to rotate the main housing with respect to the attachment bracket. Also disposed between the main housing and the attachment bracket is a swiveling hydraulic connector to allow hydraulic power to be passed though the slewing ring without impeding the rotational movement of the connection.

The main housing includes an access door 64 to allow access to the hydraulic lines contained within. The main housing is attached to the main beam 54 with a pivoting joint 74. The pivoting joint 74 may be a pin with bushings or other appropriate mechanism to allow a pivoting movement. One or preferably two hydraulic arms 66 may connected between the main housing and the main beam to hydraulically control the relative positions of the main beam and the main housing.

The main beam 54 includes a generally tubular beam 76 with a pair of claws 68 disposed on the ends of the tubular beam. The pair of claws 68 are slidably disposed on the tubular beam 76 so that the pair can be slid back and forth. The contemplated range of motion of each claw may be 4, 5, 6, 7, 8, 9, 10, 11 or 12 inches. In one preferred embodiment, the claws 68 slide back and forth as one so that the distance between the claws remains constant.

Figure 7:
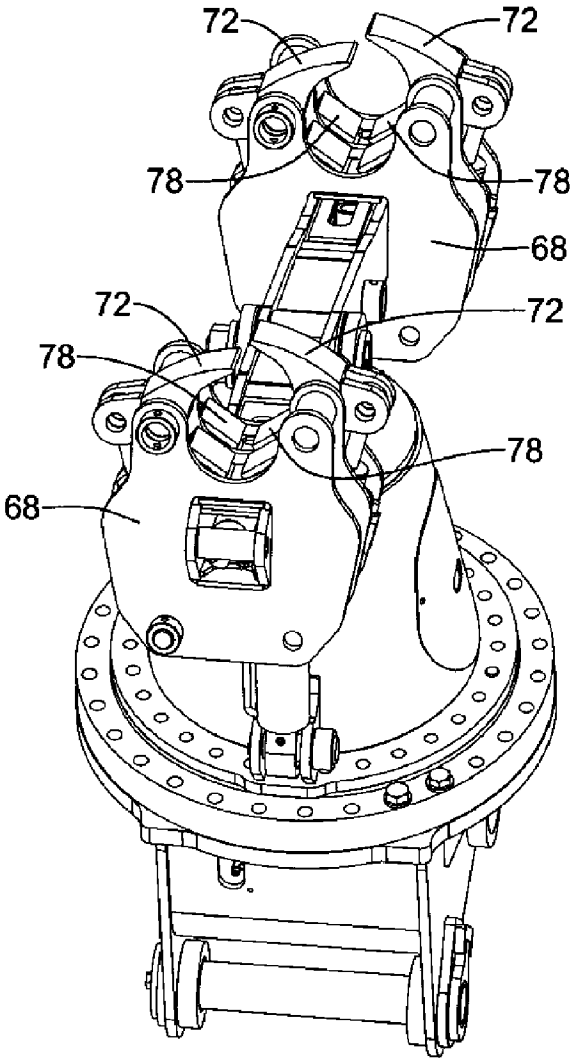
FIG. 7 is another diagrammatic orthogonal view of the grapple attachment of FIG. 5.

Each claw includes an arm housing, which is disposed over the tubular beam 76, and arms 72, which are actuated by hydraulics 70 to grab a drill pipe 56. As can be best seen in FIG. 7, the claws may also include pads 78, arranged in a "V", to help secure a drill pipe in place once grabbed by the arms. The pads 78 are somewhat resilient to help the drill pipe resist lateral and rotational movement once clamped.

This embodiment allows positioning of the drill pipe by moving the boom arm of the piece of heavy equipment, by rotation of the main housing, by pivoting of the main beam, and by sliding the claws on the main beam.

An embodiment may also include a horn and lights. In some pieces of heavy equipment, the horn and lights may be disconnected to allow attachment of this grapple attachment. Putting a horn and lights on the attachment restores this functionality.

Figure 8A:
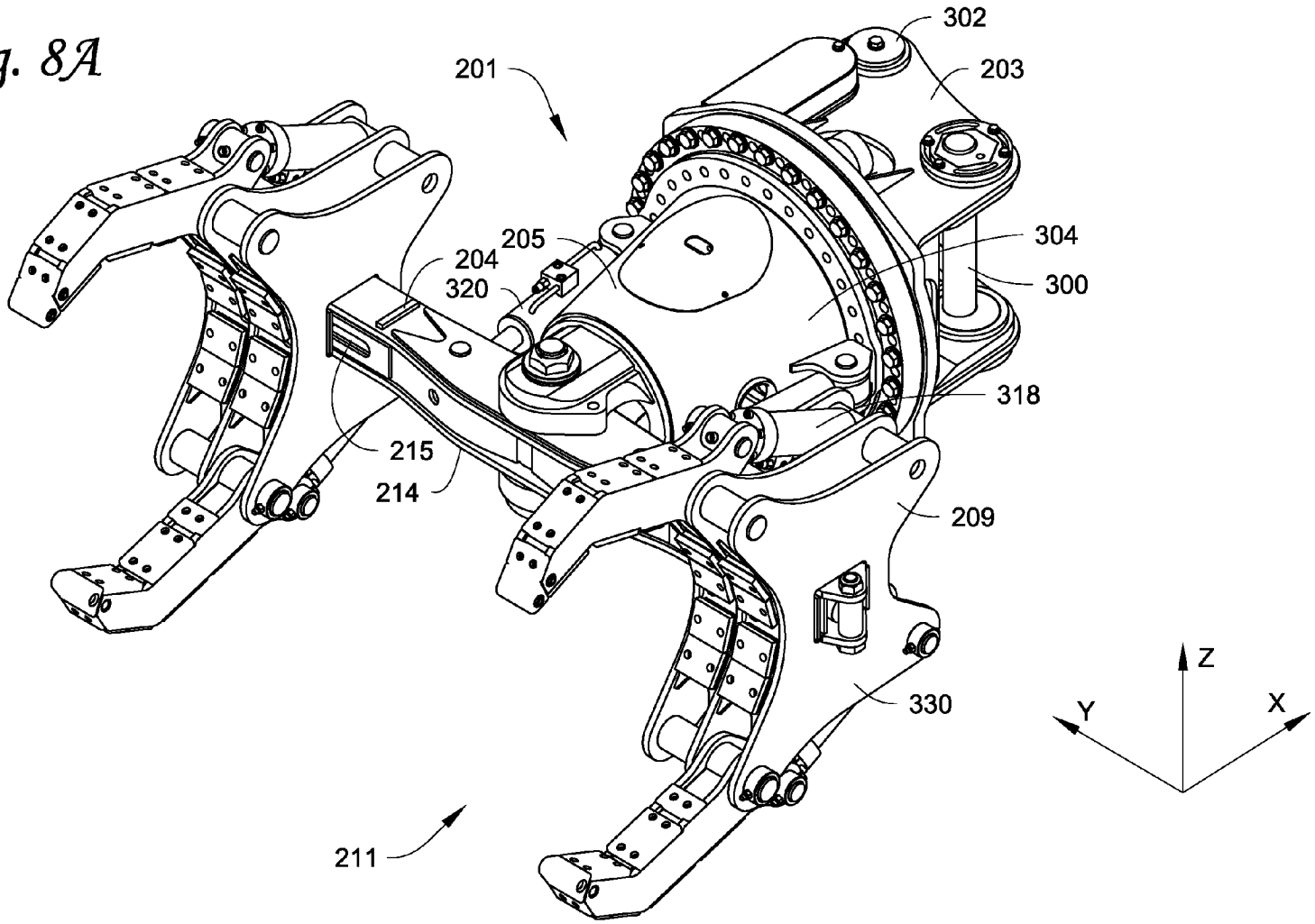
FIG. 8A illustrates a grapple attachment with a gripping assembly.
Figure 8B:
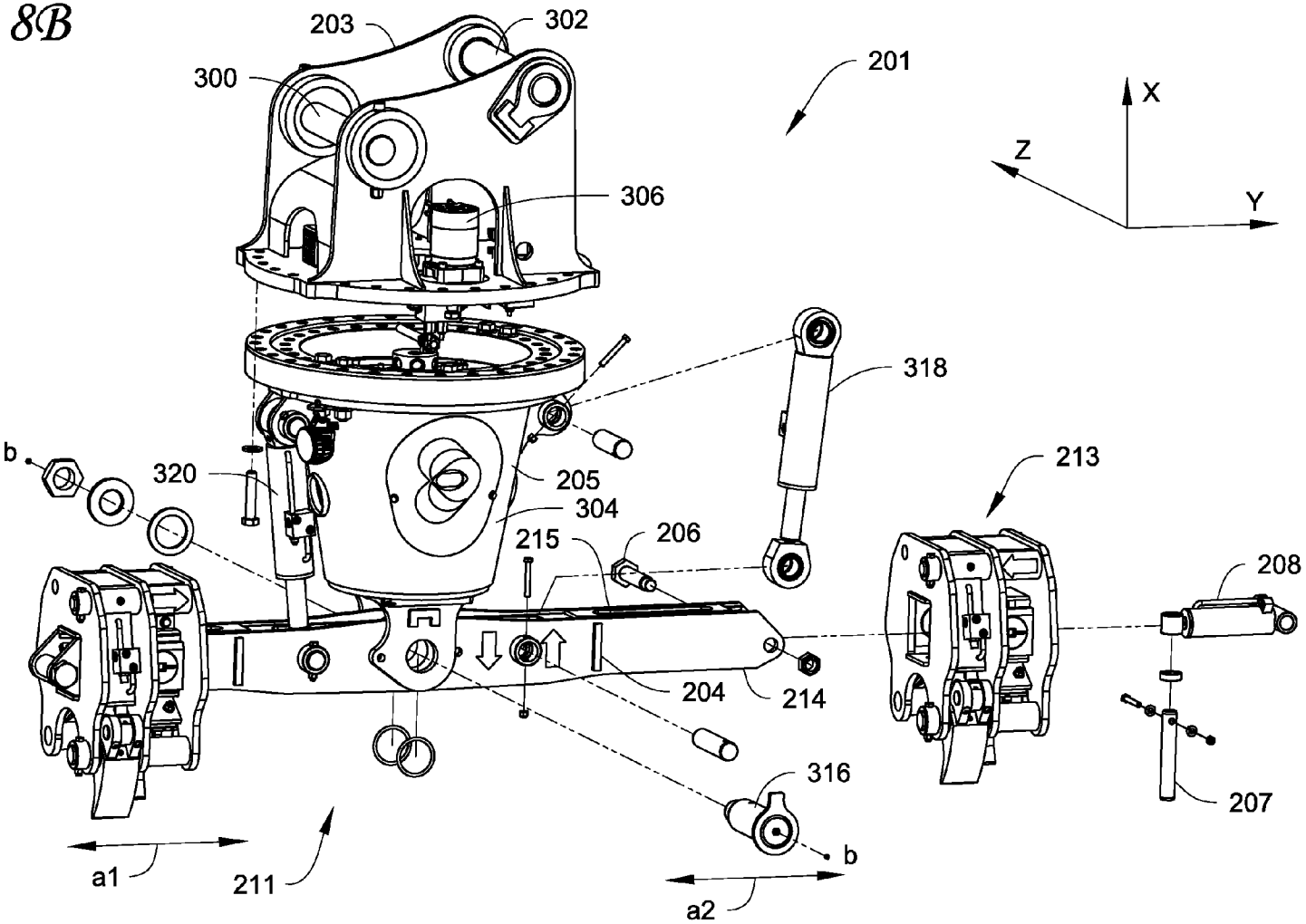
FIG. 8B is an exploded view of a grapple attachment similar to FIG. 8A but with a set of gripping members illustrated in FIG. 13.
Figure 9:
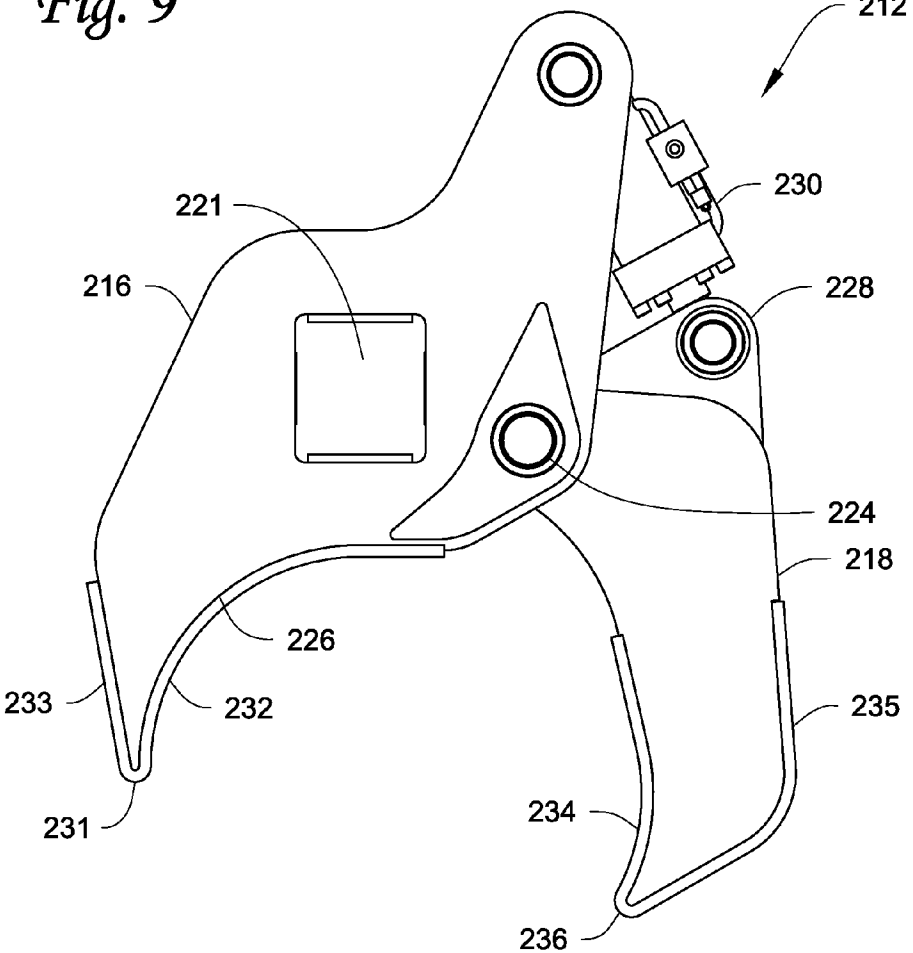
FIG. 9 is a front view of another embodiment of a gripping member having one stationary grab arm and one movable grab arm.

FIGS. 8A and 8B illustrate examples of a grapple attachment 201 provided with a gripping assembly 211 having different embodiments of gripping members 209, 213. Another embodiment of a gripping member 212 is illustrated in FIG. 9. The gripping members 209, 212, 213 are designed to be interchangeably mountable on the gripping assembly 211 to allow alteration of the type of gripping member 209, 212, 213 used on the grapple attachment 201.

The grapple attachment 201 comprises a bracket attachment 203, a swing drive 306, a lower head assembly 205, tilt actuators 318, 320 and the gripping assembly 211. The bracket attachment 203 is configured to attach to a piece of construction equipment, for example an excavator, trackhoe, backhoe, etc. In the illustrated embodiment, the bracket attachment 203 attaches to the construction equipment via a pair of spaced attachment pins 300, 302.

Figure 17:
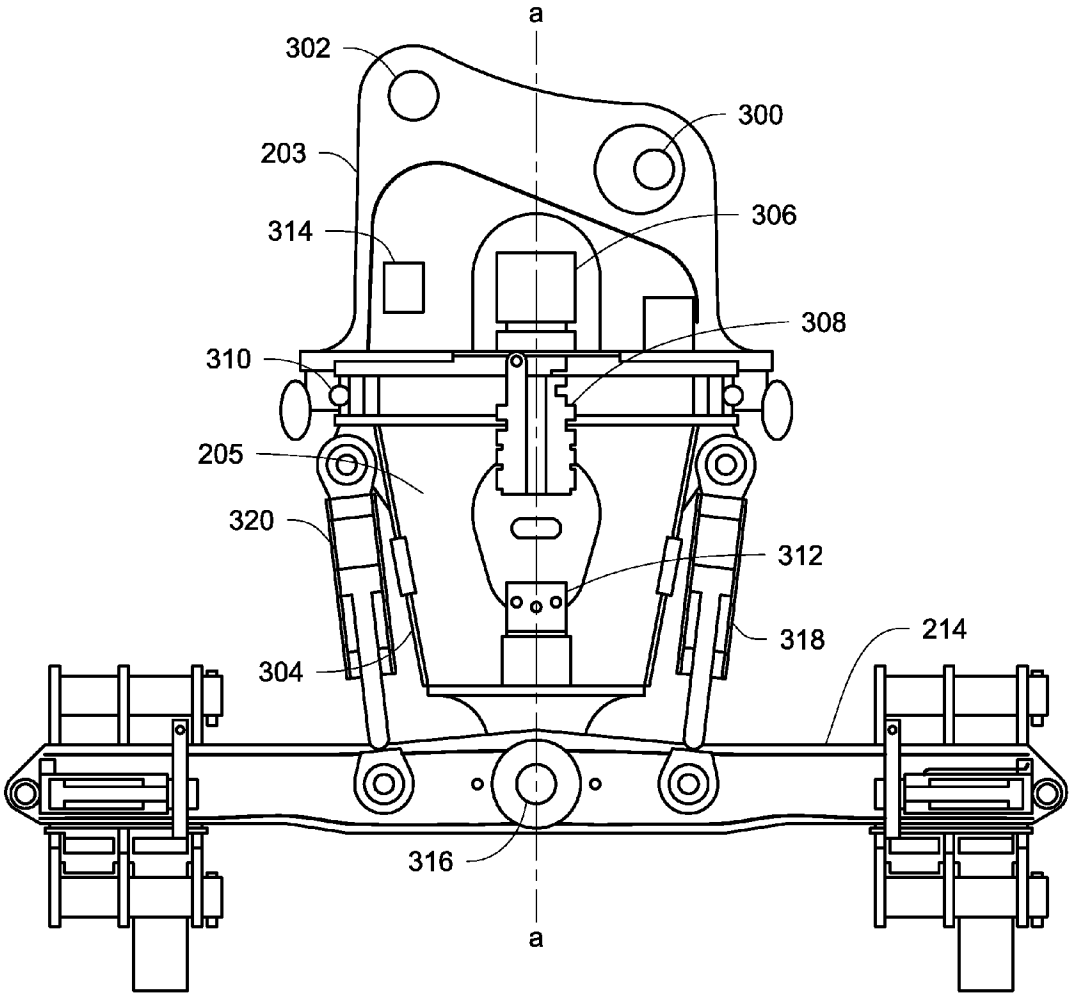
FIG. 17 is a cross-sectional view of the grapple attachment.

The swing drive 306 rotates the lower head assembly 205 about a swivel axis a-a (shown in FIG. 17) that extends along the x-axis or vertical axis through a centre point of the lower head assembly 205. With reference to FIG. 17, the rotation control includes a hydraulic swing motor 306 that causes rotation of the lower head assembly 205 about the axis a-a driven by the motor 306. A hydraulic swivel 308 transfers hydraulic pressure between the stationary/rotating boundary between the bracket attachment 203 and the lower head assembly 205 for use by various hydraulic components of the grapple attachment 201. A swing bearing 310 between the bracket attachment 203 and the lower head assembly 205 permits rotation relative to the bracket attachment 203. A hydraulic manifold 312 is located in the housing 304 for directing hydraulic fluid to various hydraulic actuators. A main hydraulic control valve 314 is mounted on the bracket attachment 203.

With continued reference to FIGS. 8A, 8B and 17, the gripping assembly 211 is pivotally connected to the lower head assembly 205 by a pivot pin 316 so that the gripping assembly 211 can pivot about a pivot axis b-b disposed on a z-axis or lateral axis that is substantially perpendicular to the swivel axis a-a.

The gripping assembly 211 comprises a longitudinal support structure or main beam structure 214 that supports various embodiments of the gripping members 209, 212, 213. The main beam structure 214 extends along a longitudinal axis (y-axis) that is substantially perpendicular to the swivel axis a-a and the pivot axis b-b. The main beam structure 214 can have any configuration suitable for supporting the gripping members 209, 212, 213 and performing the other functions of the main beam structure 214 implied by this description. In the illustrated embodiment, the main beam structure 214 is a generally rectangular, tubular beam that has a generally square cross-section. The main beam structure 214 can alternatively be, for example, cylindrical or triangular, or be shaped like an I- or H-beam, and can also be a solid structure.

Tilt actuators 318, 320 are provided for positively controlling pivoting movement of the main beam structure 214 about the pivot axis b-b, thereby controlling the angle of tilt of the gripping assembly 211 and a pipe held thereby. The tilt actuators 318, 320 are identical in construction although they could be different if desired. In the illustrated embodiment, the tilt actuators 318, 320 are hydraulic actuators, although other types of actuators could be used, for example pneumatic actuators or mechanical actuators. The tilt actuators 318, 320 have a first end connected to the housing 304 of the lower head assembly 205 and a second end connected to the main beam structure 214.

As shown by the arrows in FIG. 8B, at least one of the gripping members 213 (as well as the gripping members 209, 212), or both of the gripping members 213, are designed to be adjustable in position relative to the swivel axis a-a and the pivot axis b-b in a direction parallel to the longitudinal axis y.

For example, the gripping members 209, 212, 213 can be slidably disposed on the main beam structure 214. For each of the gripping members 209, 212, 213, the means for slidably disposing the gripping members 209, 212, 213 on the main beam structure 214 and for adjusting the positions of the gripping members 209, 212, 213 on the main beam structure 214 are the same and will be described in the following paragraph with respect to the gripping members 213.

The gripping members 213 are longitudinally adjustable on the main beam structure 214 by sliding back and forth on the main beam structure 214 in the directions shown by the arrows a1, a2. The gripping members 213 are disposed at opposite ends of the main beam structure 214. For each gripping member 213, a shift actuator 208 is mounted within the main beam structure 214 along the longitudinal direction thereof. The gripping members 213 are connected to one end of the shift actuator 208 via, for example, a fastening pin 207. The other end of the longitudinal actuator 208 is fixed to the main beam structure 214 via a fastening means 206, for example, a bolt. The shift actuators 208 are illustrated as hydraulic actuators although other types of actuators can be used, such as pneumatic or mechanical actuators.

Actuation of the shift actuator 208 moves the attached gripping member 213 via the fastening pin 207 along the main beam structure 214 on the longitudinal axis. Actuation of the shift actuator 208 results in the shortening or lengthening of the shift actuator 208. As the fastening pin 207 is connected to one end of the shift actuator 208, the fastening pin 207 thus moves in relation to the shift actuator 208. And, as the gripping member 213 is connected to the fastening pin 207, the gripping member 213 thus moves in relation to the fastening pin 207 and the shift actuator 208. The fastening pin 207 is held within and travels in a longitudinal slot 215 in the main beam structure 214 thereby controlling the pathway of the fastening pin 207. Stops 204 are provided on the main beam structure 214 to limit the range of movement of the gripping members 213 and prevent the gripping members 213 from over travel.

In one embodiment, the gripping members 213 and the shift actuators 208 can be configured to move the gripping members 213 in a number of ways. For example, the gripping members 213 can move simultaneously in the same direction such that the distance between the gripping members 213 remains the same. Alternatively, the gripping members 213 can be made to move independently of each other, or move simultaneously with each other, to allow adjustment in the distance between the gripping members 213.

Instead of moving the gripping members 213, it is contemplated herein that the main beam structure 214 can be configured to be alterable in length while the gripping members 213 remain relatively fixed on the main beam structure 214, so as to shift the positions of the gripping members 213, either with the same distance therebetween or altering the distance between the gripping members 213. Alternatively, the main beam structure 214 could be configured so that it is adjustable along the longitudinal axis in relation to the lower head assembly 5.

Figure 11:
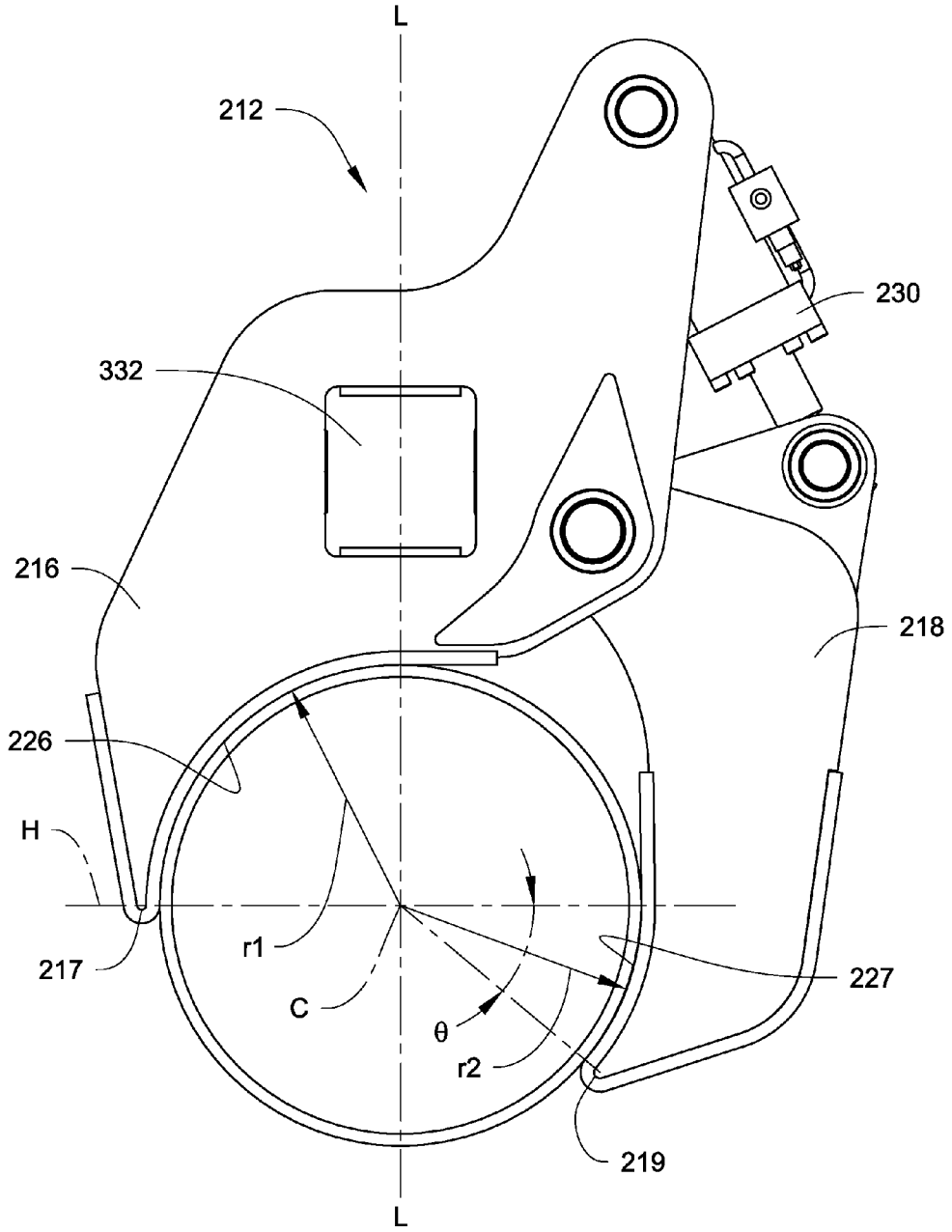
FIG. 11 is a diagrammatic front view of the gripping member of FIG. 9 while gripping a pipe.

As indicated above, the gripping members 213 are mounted so as to be replaceable by differently configured gripping members 209, 212, 213 designed to perform the broad function of gripping an object, but in different ways or for different sized objects. Each of the gripping members 209, 212, 213 includes a support member 330 that includes a main beam structure opening 332 (as shown in FIG. 11) extending laterally therethrough that is configured to allow passage of the main beam structure 214 when the gripping member 209, 212, 213 is mounted on the main beam structure 214. The support member 330 can take on a number of different configurations as long as the support member 330 can support one or more grab arms as discussed further below, and the support member 330 can be suitably mounted on the main beam structure 214. In the embodiments illustrated and described herein, the support members 214 are made from spaced apart metal plates. However, the support members 214 could be forged or molded from solid metal. As illustrated and described herein, the gripping members 209, 212, 213 are mounted on the main beam structure 214 so that they are movable and can be longitudinally adjusted. However, the gripping members 209, 212, 213 can be fixedly attached to the main beam structure 214 so that they have no longitudinal movement.

Figure 10:
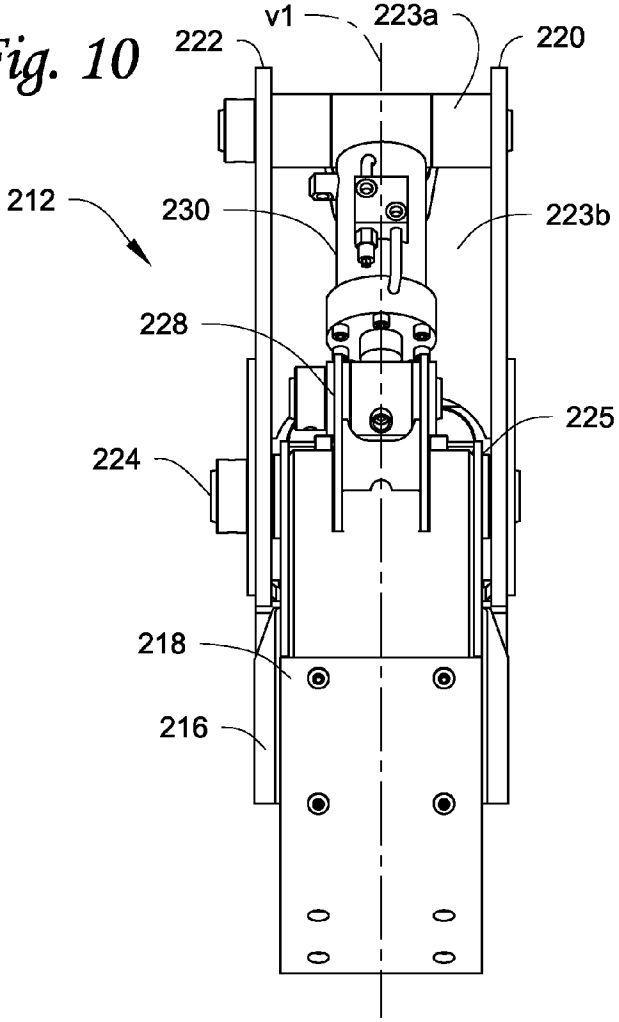
FIG. 10 is a side view of the gripping member of FIG. 9.

In one embodiment, as shown in FIGS. 9 and 10, the gripping member 212 includes a first grab arm 216 and a second grab arm 218 pivotably connected to the first grab arm 216. Alternatively, the first grab arm 216 can be pivotably connected to the second grab arm 218. When viewing the gripping member 212 from the side, as in FIG. 10, the grab arms 216, 218 are positioned so that each grab arm 216, 218 has the same vertical axis v1, i.e. the grab arms 216, 218 are not offset. In another embodiment, the grab arms 216, 218 could be on different vertical axes, thereby being offset from each other.

The gripping member 212 includes a first plate 220 and second plate 222 spaced from and parallel to each other. The first plate 220 and second plate 222 are connected to each other. The plates 220, 222 can be connected by the use of suitable fastening means 223*a*, 223*b*, as shown in FIGS. 9 and 10, sufficient to keep the plates 220, 222 spaced and form a strong support member 330. For example, the fastening means can be rods, bolts, pins, and/or spacer plates or any other method of fastening. A main beam structure opening 221 is provided in each of the plates 220, 222 to receive the main beam structure 214 of the gripping assembly 211. The main beam structure openings 221 are aligned with each other to form the opening 332. In the embodiment shown, the main beam structure openings 221 are shown as being square in shape, but it is understood that the main beam structure openings 221 can be any shape so long as the main beam structure 214 can be received and the gripping member 212 can not move rotationally on the main beam structure 214. The shown main beam structure openings 221 are closed in that they are bounded on all sides by the plate 220, 222 but it is understood that the main beam structure openings 221 can be open or slotted on one side or more sides.

The first grab arm 216 is integrally formed with the gripping member 212 and is non-pivotable. The second grab arm 218 is pivotably connected between the first plate 220 and the second plate 222. In the embodiment shown, a rod as a fastening means 224 is disposed in a tube arm pivot 225 of the second grab arm 218 and the fastening means 224 is connected to the first plate 220 and the second plate 222. Other methods of attaching the second grab arm 218 to the plates 220, 222 can be used so long as the second grab arm 218 pivots.

As shown in FIGS. 9 and 10, the second grab arm 218 has a pivot main beam structure 228 and is pivotably connected to one end of an actuator 230. The other end of the actuator 230 is pivotably connected between the first plate 220 and second plate 222 of the gripping member 212. Actuation of the actuator 230 moves the second grab arm 218 between an open or non-gripping position and a closed or gripping position.

The gripping member 212 is mountable on the main beam structure 214 by inserting the main beam structure 214 through the aligned openings 221. Once mounted on the main beam structure 214, the gripping member 212 cannot rotate relative to the main beam structure 214. The fastening pin 207 is then connected to the gripping member 212, and the fastening means 206 connected to the actuator 208 and the main beam structure 214, as illustrated in FIGS. 8A, 8B and 17. This prevents the gripping member 212 from sliding off of the main beam structure 214.

As illustrated in FIG. 11, the support member 330 and the first and second grab arms 216, 218 define an object receiving area when the first and second grab arms 216, 218 are at the gripping position in which is received an object such as a pipe. The object receiving area is disposed below the main beam structure opening 332. In addition, the object receiving area includes a center C, and the object receiving area and the main beam structure opening 332 are positioned relative to each other such that in a front view of the gripping member as in FIG. 11, a vertical line L-L extending through the center of the object receiving area also extends through a center of the main beam structure opening 332. The gripping members 209, 213 define similar object gripping areas and the relation between the gripping areas and the main beam structure openings is the same.

A horizontal plane H is located at the tip 217 of the first grab arm 216 and is perpendicular to the vertical line L-L that bisects the main beam structure opening 332. The first grab arm 216 has a concave contact surface 226 that has a radius r1 that is, preferably, approximately equal to the radius of the pipe. The radius r1 can be, for example, approximately 10 inches for use with pipe having a twenty inch outer diameter. Alternatively, the concave contact surface 226 may have a radius r1 that is slightly larger than half the diameter of the pipe. When in the gripping position, the first grab arm 216 tip 217 is configured to be on the same horizontal plane H as the centre point C of the circle created by the pipe at an approximate distance r1 from the centre point C.

The second grab arm 218 is preferably configured so that it has a concave contact surface 227 that has a radius r2 that is approximately equal to the radius of the pipe. Alternatively, the concave contact surface 227 may have a radius r2 that is slightly larger than half the diameter of the pipe. The tip 219 of the second grab arm 218 is configured to be disposed at an angle θ of approximately 40° from the horizontal plane H and at an approximate distance r2 from the centre point C. It is to be understood that the angle θ can be more or less than 40°. The first grab arm 216 and second grab arm 218 are configured so that the concave contact surfaces 226, 227 come in contact with the pipe when gripping the pipe.

As shown in FIG. 9, each grab arm 216, 218 has a profile that tapers towards a free end. The gripping member 212 is configured so that only the second grab arm 218 is movable when the gripping motion is actuated. In another embodiment, the gripping member 212 is configured so that the first grab arm 216 is movable relative to the second grab arm 218 when the gripping motion is actuated. The actuator 230 is used to actuate and move the second grab arm 218 between a gripping and non-gripping position. Load hold valves are incorporated on the actuators 230 such that the second grab arm 218 stays locked in place in the event of a hydraulic hose or pressure failure.

The grab arms 216, 218 can include resilient pads 231, 232, 233, 234, 235, 236 as shown in FIG. 9. The pads 232, 234 are preferably vulcanized rubber with a steel backing but can be any material, including rubber or plastic, that provides a positive grip while protecting the pipe. The pads 232, 234 can be somewhat resilient to aid the pipe to resist lateral and rotational movement once clamped. The pads 233, 235 are protection pads that are preferably a UMHW plastic or Nylatron®, but can be any type of plastic, rubber or other material. The pads 233, 235 allow the grab arms 216, 218 to contact adjacent pipes while protecting the contacted pipes from damage and allow the grab arms 216, 218 to slide easily along the contacted pipe. The pads 231, 236 are tip pads that can be made of the same material as the pads 232, 234 or the protection pads 233, 235. The pads 231, 232, 233, 234, 235, 236 are configured to allow for the removal and replacement of the pads 231, 232, 233, 234, 235, 236. The pads 231, 232, 233, 234, 235, 236 are preferably installed on the grab arms 216, 218 so any part of the gripping member 212 that comes in contact with the pipe, or with adjacent pipes, is covered by the pads 231, 232, 233, 234, 235, 236. The pads 231, 232, 233, 234, 235, 236 can be provided as one continuous piece or can be provided in sections. When open, the grab arm 216, 218 tips 217, 219 extend slightly wider than the diameter of the pipe such that the gripping member 212 can be placed over the pipe. In addition, the gripping member 212 is configured to limit the amount the second grab arm 218 can move towards the first grab arm 216 when a gripping position is actuated, thus preventing damage to the pipe by crushing. This limitation can be incorporated physically or through electronic controls or software.

Figure 12:
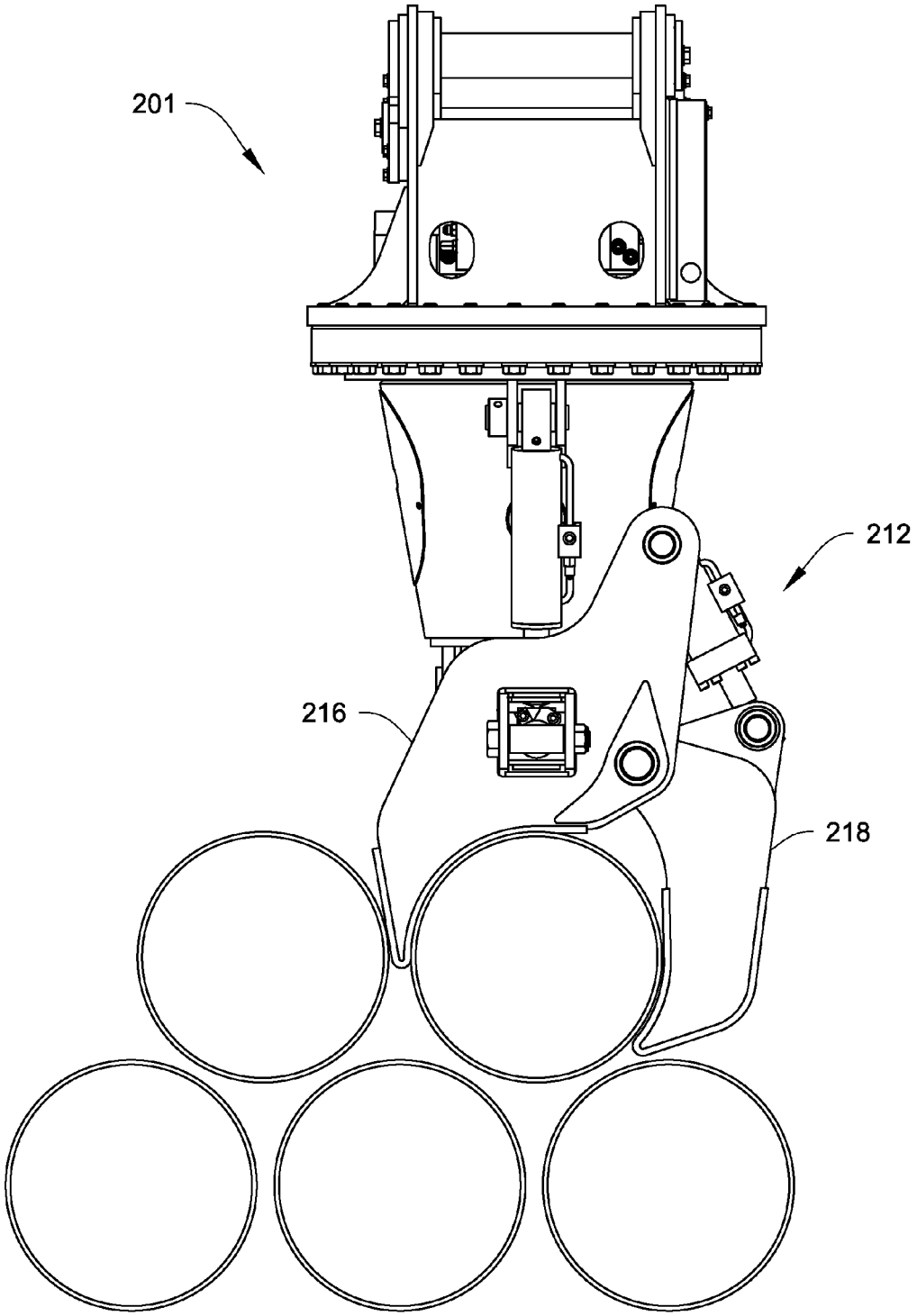
FIG. 12 is an illustration of the gripping assembly with the gripping members of FIG. 9 in use and removing a single pipe from a pipe stack.

It is preferred that the grab arms 216, 218 do not open to such an extent to permit the gripping member 212 from spanning the top of more than one pipe to prevent picking up more than one pipe. As shown in FIG. 12, as the gripping member 212 is lowered toward a pipe stack, the profile of the grab arms 216, 218 guide the grab arms 216, 218 down the curved outer surfaces between two pipes and the narrow free end of the first grab arm 216 permits the first grab arm 216 to more easily fit between adjacent pipes. Once the second grab arm 218 is past the center line of the pipe, the second grab arm 218 is actuated to a gripping position so that the pipe is securely held within the gripping member 212 and the pipe can be safely lifted.

The tip 217 of the first grab arm 216 contacts the pipe at approximately the center line of the pipe. The gripping member 212 is thus able to grasp and load or offload the pipes, without disturbing adjacent pipes.

Figure 14:
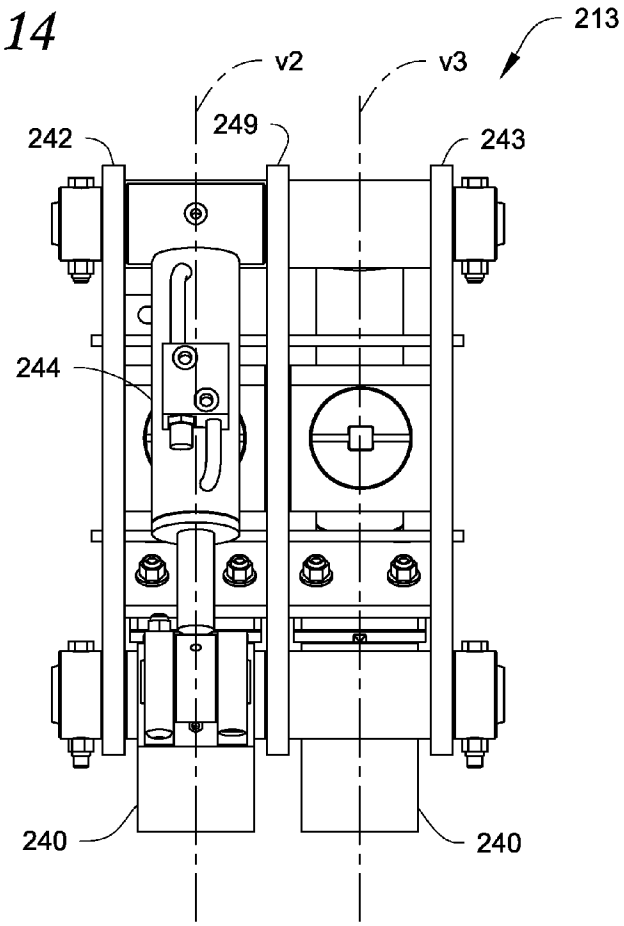
FIG. 14 is a side view of the gripping member of FIG. 13.
Figure 13:
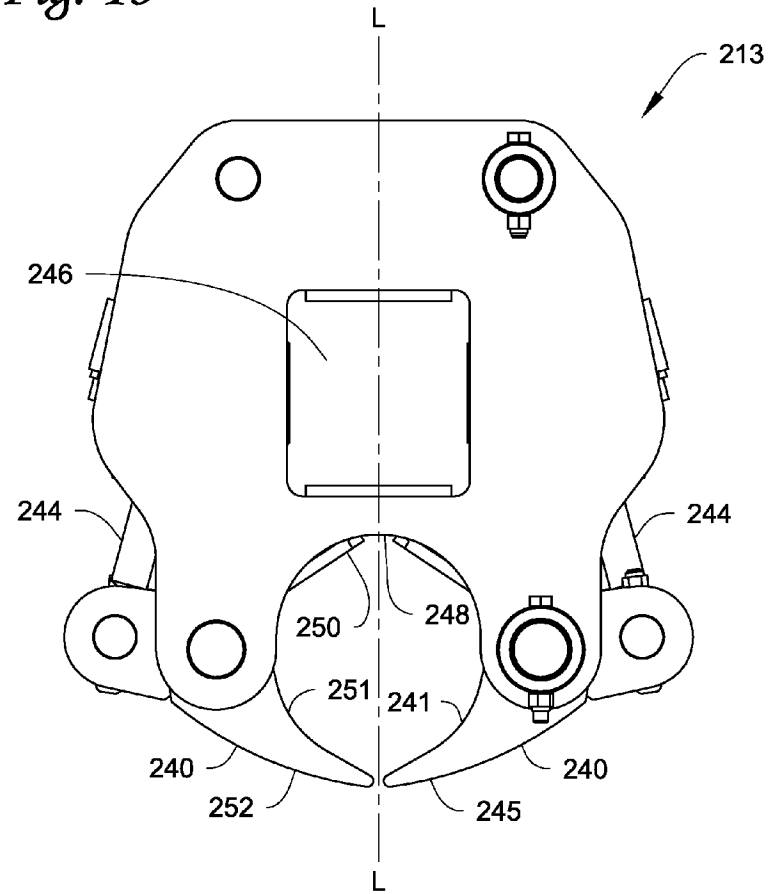
FIG. 13 is a front view of one of the gripping members shown in FIG. 8B having two crescent shaped movable grab arms.

In the embodiment shown in FIGS. 8B, 13 and 14, the gripping member 213 is provided with two grab arms 240 that are movable. The gripping member 213 includes a first plate 242 and a second plate 243 spaced apart and parallel to each other. The grab arms 240 are pivotably connected to the first and second plates 242, 243. Separate actuators 244 are connected to each grab arm 240. One end of each actuator 244 is connected to the respective grab arm 240 and the other end of the actuator 244 is connected to the plates 242, 243.

The gripping member 213 is configured to be slidably connected to the main beam structure 214 in a manner similar to the gripping member 212. As shown in FIG. 13, the gripping member 213 is provided with main beam structure openings 246 in the plates 242, 243 where the openings 246 are aligned with each other. When viewing the gripping member 213 from the side, as in FIG. 14, the grab arms 240 are positioned so that the grab arms 240 have different vertical axes v2, v3, i.e. the grab arms 240 are offset. When offset, the grab arms 240 can be configured so that the grab arms 240 bypass each other when in the gripping position. In another embodiment, the grab arms 240 have the same vertical axis and are not offset.

In the embodiment shown, the main beam structure openings 246 are shown as being square in shape, but it is understood that the main beam structure openings 246 can be any shape so long as the main beam structure 214 can be received and the gripping member 213 can be mounted on the main beam structure 214. The shown main beam structure openings 246 are closed in that they are surrounded on all sides by the plate 242, 243 but it is understood that the main beam structure openings 246 can be open or slotted on one side or more sides.

The gripping member 213 includes a third plate 249 that is disposed between and connected to the first plate 242 and the second plate 243. The third plate 249 includes a main beam structure opening that aligns with the main beam structure openings 246 of the first plate 242 and the second plate 243. One of the grab arms 240 is connected between the first plate 242 and the third plate 249 and the other grab arm 240 is connected between the second plate 243 and the third plate 249 so that the grab arms 240 are on different vertical axes v2, v3. It is to be understood that the inclusion of a third plate 249 is not necessary as long as a means is provided that allows separation of the grab arms 240. For example, spacers or washers can be inserted between the grab arms 240.

The plates 242, 243, 249 have a concave contact surface 248 that has a radius approximately equal to half the diameter of the pipe to be moved. In another embodiment, the concave contact surfaces 248 can have a radius that is slightly larger than the diameter of the pipe to be moved. In another embodiment, the contact surfaces 248 are not related to the diameter of the pipe and can have any radius or can be a straight edge.

The grab arms 240 are configured so that they open and close simultaneously. When open, the grab arms 240 preferably extend slightly more than the diameter of a pipe. Preferably, the grab arms 240 do not open to a width that would span the top of more than one pipe to prevent gripping more than one pipe. As the gripping member 213 is lowered, the profile of the grab arms 240 guide the grab arms 240 down and around the curved outer surfaces of the pipe and the narrow free end of the grab arms 240 permits the grab arms 240 to more easily fit between adjacent pipes. Once the grab arms 240 are past the center line of the pipe, the grab arms 240 are actuated so that the pipe is moved up to and against the concave contact surface 248 so that the pipe is securely held within the gripping member 213 and can be safely moved.

The grab arms 240 are configured so that the front side 241 comes in contact with the pipe when closed around the pipe. Each grab arm 240 has a profile that tapers towards a free end. The gripping member 213 is configured so that both grab arms 240 move simultaneously when the gripping motion is actuated. The actuators 244 are used to actuate and move the grab arms 240. Each grab arm 240 has its own actuator 244. Load hold valves are incorporated on the actuators such that the grab arms 240 stay locked in place in the event of a hydraulic hose or pressure failure.

The free end of the grab arm also has a back side 245. In one embodiment, as illustrated in FIG. 13, the front side 241 of each grab arm 240 is a curved gripping surface whose radius is approximately half the diameter of the pipe. The grab arm 240 free end is elongated allowing for pipe to be picked from the center of a pipe rack.

The concave contact surface 248, the front side 241 and back side 245 of the grab arms 240 can include pads 250, 251, 252. The concave contact surface 248 pads 250 are installed to create a generally V-shape allowing for a tight grip. The pads 250, 251, 252 can be provided as one continuous pad that covers the entire surface of the grab arms 240 or can be provided as non-continuous individual pieces that cover a major portion of the grab arms 240.

The pads 250, 251 are preferably vulcanized rubber with a steel backing but can be any material that provides a positive grip while protecting the pipe, including rubbers, plastics or other materials. The pads 250, 251 can be somewhat resilient to aid the pipe to resist lateral and rotational movement once clamped. Protection pads 252 are preferably a UMHW plastic or Nylatron®, but can be any type of plastic, rubber or other material. The protection pads 252 allow the grab arms 240 to contact adjacent pipes while protecting the pipes from damage and allows the grab arms 240 to slide easily along the adjacent pipe.

Grab arm 240 tip pads can be provided and made of the same material as the pads 250, 251 or the protection pads 252. The pads 250, 251, 252 are configured to allow for the removal and replacement of the pads 250, 251, 252. The pads 250, 251, 252 are preferably installed on the grab arms 240 so any part of the gripping member 213 that comes in contact with the pipe, or with adjacent pipes, is covered by the pads 250, 251, 252. The pads 250, 251, 252 can be provided as one continuous piece or can be provided in sections.

As illustrated in FIG. 13, the support member 330 and the grab arms 240 define an object receiving area when the first and second grab arms 240 are at the gripping position in which is received an object such as a pipe. The object receiving area is disposed below the main beam structure opening defined by the aligned openings 246. In addition, the object receiving area includes a center, and the object receiving area and the main beam structure opening are positioned relative to each other such that in a front view of the gripping member as in FIG. 13, a vertical line L-L extending through the center of the object receiving area also extends through a center of the main beam structure opening.

Figure 16:
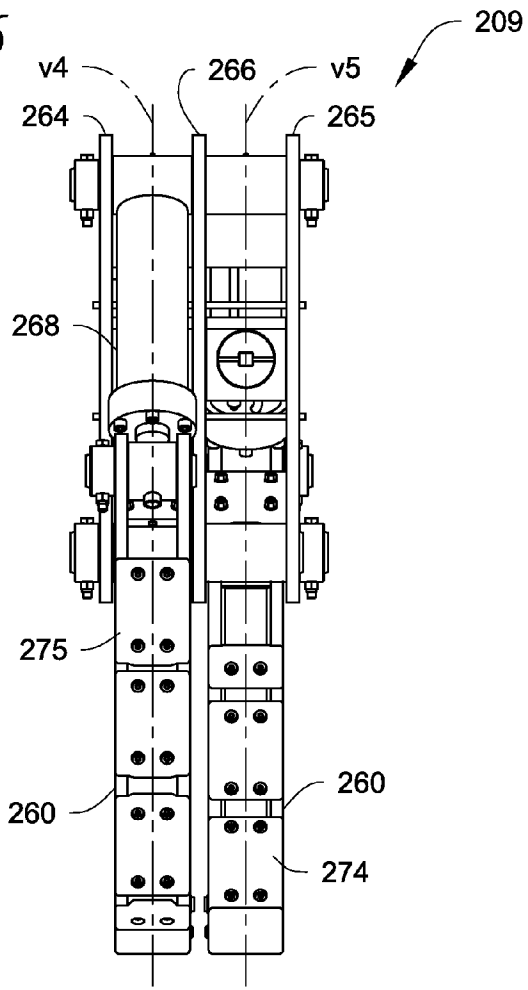
FIG. 16 is a side view of the gripping member of FIG. 15.
Figure 15:
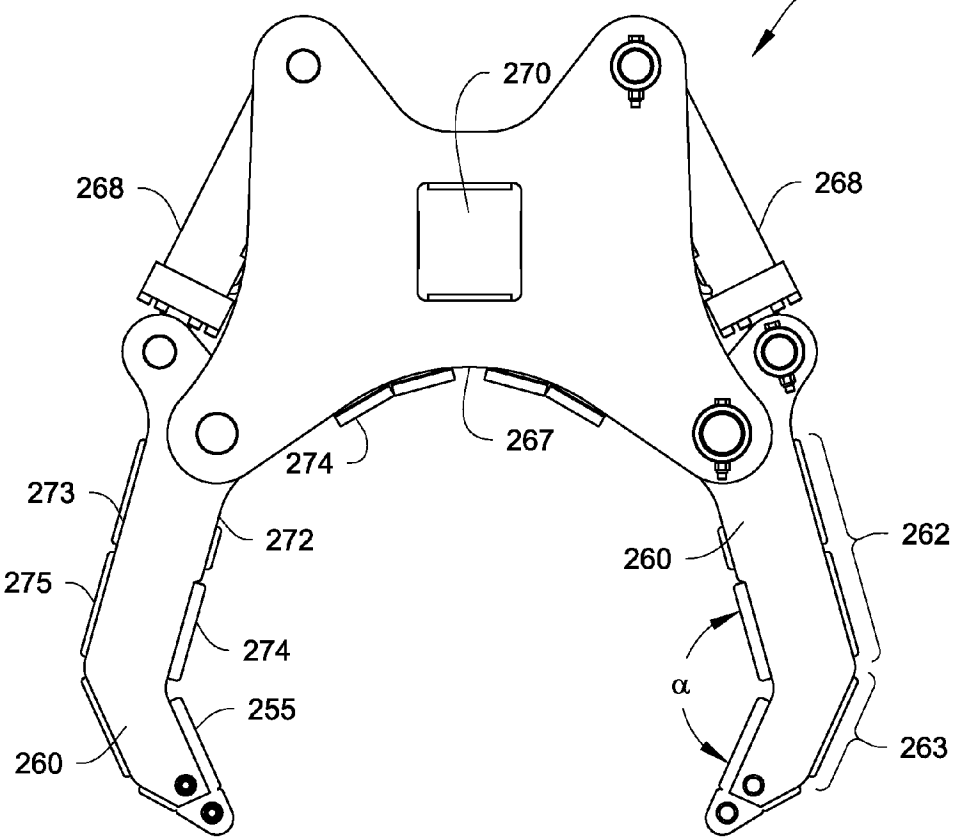
FIG. 15 is a front view of one of the gripping members from FIG. 8A having two modified L-shaped movable grab arms.

Details of the gripping member 209 are shown in FIGS. 15 and 16. The gripping member 209 includes two movable grab arms 260. Each grab arm 260 contains an elongated section 262 and a shorter section 263, that are integrally connected, where an angle $\alpha$ is created where the sections 262, 263 meet. Due to the configuration of the grab arms 260, this embodiment creates six points of contact on the pipe. The elongation and angle α of the grab arms 260 allows for pipe to be picked from a pipe stack without unduly moving the adjacent pipes.

In the embodiment shown, the gripping member 209 includes a first plate 264 and a second plate 265 spaced apart and parallel to each other. The grab arms 260 are pivotably connected to the first and second plates 264, 265. Separate actuators 268 are connected to each grab arm 260. One end of the actuator 268 is connected to the grab arm 260 and the other end of the actuator 268 is connected to the plates 264, 265.

The gripping member 209 is configured to be slidably connected to the main beam structure 214 similar to the gripping members 212, 213. As shown in FIG. 15, the gripping member 209 is provided with aligned main beam structure openings 270 in the plates 264, 265. In the embodiment shown, the main beam structure openings 270 are shown as being square in shape, but it is understood that the main beam structure openings 270 can be any shape.

When viewing the gripping member 209 from the side, as in FIG. 16, the grab arms 260 are positioned so that the grab arms 260 have different vertical axes v4, v5, i.e. the grab arms 260 are offset. The grab arms 260 can be configured so that when offset they bypass each other in the gripping position. In another embodiment, the grab arms 260 have the same vertical axis and are not offset.

A third plate 266 is disposed between and connected to the first plate 264 and the second plate 265. The third plate 266 also includes a main beam structure opening that aligns with the main beam structure openings 270 of the first plate 264 and the second plate 265. One of the grab arms 260 is connected between the first plate 264 and the third plate 266 and the other grab arm 260 is connected between the second plate 265 and the third plate 266 so that the grab arms 260 are on different vertical axes v4, v5. It is to be understood that the inclusion of a third plate 266 is not necessary as long as a means is provided that allows separation of the grab arms 260. For example, spacers or washers can be inserted between the grab arms 260.

In one embodiment, the plates 264, 265, 266 have a concave contact surface 267 that has a radius approximately equal to half the diameter of the pipe to be moved. In another embodiment, the concave contact surface 267 can have a radius that is slightly larger than the diameter of the pipe to be moved. In another embodiment, the contact surface 267 is not related to the diameter of the pipe and can have any radius or can be a straight edge.

The grab arms 260 are configured so that they open and close simultaneously. When open, the grab arms 260 preferably extend slightly more than the diameter of a pipe and preferably do not extend wide enough to grip more than one pipe. As the gripping member 209 is lowered, the profile of the grab arms 260 guide the grab arms 260 down and around the curved outer surfaces of the pipe and the narrow free end of the grab arms 260 permits the grab arms 260 to more easily fit between adjacent pipes. Once the grab arms 260 are past the center line of the pipe, the grab arms 260 are actuated so that the pipe is moved up to and against the concave contact surface 267 so that the pipe is securely held within the gripping member 209 and can be safely moved.

The grab arms 260 are configured so that the contact surfaces 255 come in contact with the pipe when closed around the pipe. In the embodiment shown, there are six points of contact. Each grab arm 260 has a profile that tapers towards a free end. Load hold valves are incorporated on the actuators 268 such that the grab arms 260 stay locked in place in the event of a hydraulic hose or pressure failure.

The free end of the grab arm 260 has a front side 272 and a back side 273. The grab arm 260 free end is elongated allowing for pipe to be picked from the center of a pipe pile.

The concave contact surface 267, the front side 272 and back side 273 of the grab arms 260 can include pads 274, 275. The pads 274 on the concave contact surface 267 are installed in a generally V-shape allowing for a tight grip. The pads 274, 275 can be provided as one continuous pad or can be provided as non-continuous individual pieces.

The pads 274 are preferably vulcanized rubber with a steel backing but can be any material that provides a positive grip while protecting the pipe, including rubbers, plastics or other materials. The pads 274 can be somewhat resilient to aid the pipe to resist lateral and rotational movement once clamped. Protection pads 275 are preferably a UMHW plastic or Nylatron®, but can be any type of plastic, rubber or other material. The protection pads 275 allow the grab arms 260 to contact adjacent pipes while protecting the pipes from damage and allows the grab arms 260 to slide easily along the pipe.

Grab arm 260 tip pads can be provided and made of the same material as the pads 274 or the protection pads 275. The pads 274, 275 are configured to allow for the removal and replacement of the pads 274, 275. The pads 274, 275 are preferably installed on the grab arms 260 so any part of the gripping member 209 that comes in contact with the pipe, or with adjacent pipes, is covered by the pads 274, 275. The pads 274, 275 can be provided as one continuous piece or can be provided in sections.

It is understood that the shape or configuration of the grab arms is not limited to the embodiments as described above and can be any shape or configuration that allows for the encompassing and gripping of pipe.

Due to the positive control provided by the tilt actuators 318 connected to the main beam structure 214 and the use of two gripping members 209, 212, 213, pipe is able to be gripped by the grapple attachment) and controlled and placed without the use of additional manpower and without the need for precise centering of the gripping members 209, 212, 213 on the pipe. It is preferred that two gripping members 209, 212, 213 be provided for use on the gripping assembly 211 but any number of gripping members 209, 212, 213 may be provided.

The examples and embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A grapple attachment system, comprising:

a grapple attachment that includes:

an attachment bracket configured to attach the grapple attachment to a piece of construction equipment;

a swivel assembly connected to the attachment bracket and rotatable relative to the attachment bracket about a first axis;

a motor engaged with the swivel assembly to rotate the swivel assembly relative to the attachment bracket about the first axis;

an elongated main beam connected to the swivel assembly, the elongated main beam is pivotally mounted so that the elongated main beam can pivot relative to the attachment bracket about a second axis that is perpendicular to the first axis, the elongated main beam has an axis that is perpendicular to the first axis and to the second axis, and the elongated main beam is rotatable with the swivel housing about the first axis;

a first tilt actuator engaged with the elongated main beam; and a plurality of differently configured members that are each configured to be interchangeably removably mountable on the elongated main beam, each member is configured to engage a different type of object.

2. The grapple attachment system of claim 1, wherein the members comprise a plurality of differently configured modular gripping members, and each modular gripping member includes differently configured grab arms.

3. The grapple attachment system of claim 2, wherein each modular gripping member includes a support member that is configured to be removably mountable on the elongated main beam, and the grab arms are connected to the respective support member.

4. The grapple attachment system of claim 3, wherein for each of the modular gripping assemblies, the grab arms are offset from each other or aligned with each other.

5. The grapple attachment system of claim 1, wherein the elongated main beam is pivotally mounted to the swivel assembly, the swivel assembly is positioned between the attachment bracket and the elongated main beam, and the axis of the elongated main beam extends through the second axis.

6. The grapple attachment system of claim 1, further comprising a second tilt actuator connected to the elongated main beam.

7. A method, comprising:

providing a grapple attachment that includes:

an attachment bracket configured to attach the grapple attachment to a piece of construction equipment;

a swivel assembly connected to the attachment bracket and rotatable relative to the attachment bracket about a first axis;

a motor engaged with the swivel assembly to rotate the swivel assembly relative to the attachment bracket about the first axis;

an elongated main beam connected to the swivel assembly, the elongated main beam is pivotally mounted so that the elongated main beam can pivot relative to the attachment bracket about a second axis that is perpendicular to the first axis, the elongated main beam has an axis that is perpendicular to the first axis and to the second axis, and the elongated main beam is rotatable with the swivel assembly about the first axis;

a first tilt actuator engaged with the elongated main beam; and providing a plurality of differently configured members that are each configured to be interchangeably removably mountable on the elongated main beam, each member is configured to engage a different type of object.

8. The method of claim 7, wherein the members comprise a plurality of differently configured modular gripping members, and each modular gripping member includes differently configured grab arms.

9. The method of claim 8, wherein each modular gripping member includes a support member that is configured to be removably mountable on the elongated main beam, and the grab arms are connected to the respective support member.

10. The method of claim 9, wherein for each of the modular gripping assemblies, the grab arms are offset from each other or aligned with each other.

11. The method of claim 7, wherein the elongated main beam is pivotally mounted to the swivel assembly, the swivel assembly is positioned between the attachment bracket and the elongated main beam, and the axis of the elongated main beam extends through the second axis.

12. The method of claim 7, further comprising a second tilt actuator connected to the elongated main beam.

13. A method, comprising:

providing a grapple attachment that includes:

an attachment bracket configured to attach the grapple attachment to a piece of construction equipment;

a swivel assembly connected to the attachment bracket and rotatable relative to the attachment bracket about a first axis;

a motor engaged with the swivel assembly to rotate the swivel assembly relative to the attachment bracket about the first axis;

an elongated main beam connected to the swivel assembly, the elongated main beam is pivotally mounted so that the elongated main beam can pivot relative to the attachment bracket about a second axis that is perpendicular to the first axis, the elongated main beam has an axis that is perpendicular to the first axis and to the second axis, and the elongated main beam is rotatable with the swivel assembly about the first axis;

a pair of gripping members mounted on the elongated main beam;

a first tilt actuator engaged with the elongated main beam; and replacing the elongated main beam and the gripping members together as a single unit.

14. The method of claim 13, wherein the elongated main beam is pivotally mounted to the swivel assembly, the swivel assembly is positioned between the attachment bracket and the elongated main beam, and the axis of the elongated main beam extends through the second axis.

15. The method of claim 13, further comprising a second tilt actuator connected to the elongated main beam.

16. A grapple attachment, comprising:

an attachment bracket configured to attach the grapple attachment to a piece of construction equipment;

a swivel assembly connected to the attachment bracket and rotatable relative to the attachment bracket about a first axis;

a motor engaged with the swivel assembly to rotate the swivel assembly relative to the attachment bracket about the first axis;

an elongated main beam pivotally mounted to the swivel assembly so that the elongated main beam can pivot relative to the attachment bracket about a second axis that is perpendicular to the first axis, the elongated main beam has an axis that is perpendicular to the first axis and to the second axis, the axis of the elongated main beam extends through the second axis, and the elongated main beam is rotatable with the swivel housing about the first axis; and a first tilt actuator engaged with the elongated main beam for tilting the elongated main about the second axis.

17. The grapple attachment of claim 16, further comprising first and second gripping members mounted on the main beam, the first and second gripping members each include an arm housing, and first and second cooperating arms mounted on each of the arm housings.

18. The grapple attachment of claim 17, wherein the first and second gripping members are slideably disposed on the main beam to permit adjustment of the positions of the first and second gripping members on the main beam in directions parallel to the axis of the main beam.

19. The grapple attachment system of claim 16, further comprising a second tilt actuator connected to the elongated main beam for tilting the elongated main beam about the second axis.

20. A grapple attachment configured for attachment to an excavator, comprising:

an attachment bracket configured to attach the grapple attachment to the excavator;

a swivel assembly connected to the attachment bracket and rotatable relative to the attachment bracket about a first axis;

a motor engaged with the swivel assembly to rotate the swivel assembly relative to the attachment bracket about the first axis;

an elongated main beam pivotally mounted to the swivel assembly so that the elongated main beam can pivot relative to the attachment bracket about a second axis that is perpendicular to the first axis, the swivel assembly is positioned between the attachment bracket and the elongated main beam, the elongated main beam has an axis that is perpendicular to the first axis and to the second axis, the axis of the elongated main beam extends through the second axis, and the elongated main beam is rotatable with the swivel housing about the first axis;

first and second gripping members disposed on the elongated main beam and spaced from one another, the first and second gripping members each include an arm housing and first and second cooperating arms mounted on each of the arm housings; and a first tilt actuator having a first end attached to the elongated main beam for tilting the elongated main about the second axis.

21. The grapple attachment of claim 20, wherein the attachment comprises first and second attachment pins that connect the attachment bracket to the excavator.

22. The grapple attachment of claim 20, wherein the first and second gripping members are configured to pick up drill pipe from a drill pipe stack.

* * * * *